US008749390B2

(12) United States Patent
Eray

(10) Patent No.: US 8,749,390 B2
(45) Date of Patent: Jun. 10, 2014

(54) RFID ANTENNA CIRCUIT

(75) Inventor: Yves Eray, Thorigne Fouillard (FR)

(73) Assignee: Eray Innovation, Thorigne-Fouillard (FR)

( * ) Notice: Subject to any disclaimer, the term of this patent is extended or adjusted under 35 U.S.C. 154(b) by 393 days.

(21) Appl. No.: 13/133,640

(22) PCT Filed: Dec. 9, 2009

(86) PCT No.: PCT/EP2009/066749
§ 371 (c)(1),
(2), (4) Date: Jul. 18, 2011

(87) PCT Pub. No.: WO2010/066799
PCT Pub. Date: Jun. 17, 2010

(65) Prior Publication Data

US 2011/0266883 A1 Nov. 3, 2011

(30) Foreign Application Priority Data

Dec. 11, 2008 (WO) ..... PCT/FR2008/052281
Jun. 8, 2009 (FR) ..... 09 53791

(51) Int. Cl.
*G08B 13/14* (2006.01)

(52) U.S. Cl.
USPC ..... 340/572.5; 340/572.7; 343/742; 343/867

(58) Field of Classification Search
USPC ..... 340/572.4, 572.5, 572.7, 10.1; 307/104, 307/105; 235/375, 380, 487, 492, 235; 343/742, 841, 842, 867, 745, 748, 893, 343/894
See application file for complete search history.

(56) References Cited

U.S. PATENT DOCUMENTS 3,823,403 A 7/1974 Walter et al.
5,541,399 A 7/1996 de Vall
(Continued)

FOREIGN PATENT DOCUMENTS

EP 0492569 A2 12/1991
EP 0821406 B1 7/1997
(Continued)

OTHER PUBLICATIONS

French Patent Office Search Report for FR0953791 dated Jun. 21, 2011. 1 page.
(Continued)

*Primary Examiner* — Hung T. Nguyen
(74) *Attorney, Agent, or Firm* — Blakely Sokoloff Taylor & Zafman

(57) ABSTRACT

The invention concerns an RFID/NFC antenna circuit. An antenna (L) is formed by at least three turns (S), the antenna having a first end terminal (D) and a second end terminal (E), two access terminals (1, 2) to connect a charge, a tuning capacitance (C1, ZZ) for tuning at a prescribed tuning frequency, an intermediate tap (A) connected to the antenna (L) and distinct from terminals (D, E), a first connector (CON1A) connecting the intermediate tap (A) to terminal (1), a second connector (CON2E) connecting end terminal (E) to the capacitance terminal (C1E). A third connector (CON31, CON32) connects the capacitance terminal (C1X) and the second access terminal (2) respectively to a first point (P1) of the antenna (L) and to a second point (P2) of the antenna (L) connected to the first point of the antenna (L) at least one turn (S) of the antenna (L).

29 Claims, 29 Drawing Sheets

(56) References Cited

U.S. PATENT DOCUMENTS

| | | | | |
|---|---|---|---|---|
| 5,955,723 | A | 9/1999 | Reiner | |
| 6,104,278 | A | 8/2000 | Altwasser | |
| 6,262,663 | B1 | 7/2001 | Altwasser et al. | |
| 6,333,721 | B1 | 12/2001 | Altwasser | |
| 6,522,308 | B1 | 2/2003 | Mathieu | |
| 6,646,554 | B1 | 11/2003 | Goff et al. | |
| 6,987,453 | B1 | 1/2006 | Altwasser | |
| 7,034,767 | B2 | 4/2006 | Karlsen | |
| 7,119,693 | B1 | 10/2006 | Devilbiss | |
| 7,212,124 | B2 | 5/2007 | Ohkawa et al. | |
| 7,360,712 | B2 | 4/2008 | Trantoul et al. | |
| 7,812,729 | B2 * | 10/2010 | Copeland | 340/572.7 |
| 8,201,748 | B2 * | 6/2012 | Koepp et al. | 235/492 |
| 2003/0218072 | A1 | 11/2003 | Hanhikorpi | |
| 2004/0140896 | A1 | 7/2004 | Ohkawa et al. | |
| 2005/0001779 | A1 * | 1/2005 | Copeland et al. | 343/867 |
| 2007/0158438 | A1 | 7/2007 | Fukuda et al. | |
| 2007/0267506 | A1 | 11/2007 | Bashan et al. | |
| 2008/0150693 | A1 | 6/2008 | You et al. | |
| 2008/0211728 | A1 | 9/2008 | Eray | |
| 2008/0258875 | A1 * | 10/2008 | Jesme et al. | 340/10.1 |
| 2009/0315799 | A1 | 12/2009 | Eray et al. | |
| 2010/0039234 | A1 | 2/2010 | Soliven et al. | |

FOREIGN PATENT DOCUMENTS

| | | | |
|---|---|---|---|
| EP | 1031939 | A1 | 11/1998 |
| EP | 0913711 | A1 | 5/1999 |
| EP | 0704816 | B1 | 12/2002 |
| EP | 1439487 | A2 | 7/2004 |
| EP | 1653631 | A1 | 5/2006 |
| EP | 1970840 | A1 | 9/2008 |
| EP | 1975854 | A1 | 10/2008 |
| FR | 2777141 | | 10/1999 |
| FR | 2803439 | A1 | 1/2000 |
| FR | 2823888 | | 10/2002 |
| FR | 2893162 | A2 | 11/2005 |
| FR | 2904453 | A1 | 7/2006 |
| FR | 2886466 | | 12/2006 |
| FR | 2910152 | A1 | 12/2006 |
| FR | 2914458 | A1 | 3/2007 |
| GB | 2445677 | A | 7/2008 |
| JP | 2000-269725 | A | 9/2000 |
| WO | WO9829830 | A1 | 7/1998 |
| WO | WO98289830 | A1 | 7/1998 |
| WO | WO9934326 | A1 | 7/1999 |
| WO | WO2006028707 | A1 | 3/2006 |
| WO | WO2006078707 | A1 | 3/2006 |
| WO | WO2008117029 | A2 | 10/2008 |
| WO | WO2008142245 | A2 | 11/2008 |

OTHER PUBLICATIONS

International Search Report for PCT/EP2009/066749 dated Jun. 29, 2010. 2 pages.

International Search Report for PCT/FR2008/052281 dated Oct. 19, 2009. 2 pages.

* cited by examiner

Antenna - 25

Antenna - 5

Antenna - 6

Antenna - 7

Antenna - 13

Antenna - 10A

RFID ANTENNA CIRCUIT

This is a non-provisional application claiming the benefit of International Application Number PCT/EP2009/066749 filed Dec. 9, 2009.

BACKGROUND OF THE INVENTION

1. Field of the Invention

The invention concerns an RFID and NEC antenna circuit.

RFID is the abbreviation for Radio Frequency Identification.

NFC is the abbreviation for Near Field Communication.

This is a technique which allows identification of objects using a memory chip or an electronic device which, by means of a radio antenna, is capable of transmitting information to a specialized reader.

2. Description of Related Art

RFID/NFC technology is used in numerous areas, for example in mobile telephones, personal digital assistants PDAs, computers, contactless card readers, the cards themselves which are to be read without contact, but also passports, identification or description tags, USB keys, SIM and (U)SIM cards called "RFID or NEC SIM card", stickers for Dual or Dual Interface cards (the sticker itself having an RFID/NFC antenna), watches.

In RFID/NFC technology, the antenna of a first RFID circuit (Reader) electromagnetically radiates a radiofrequency signal over a certain distance which contains data that is to be received by the antenna of a second REID circuit (transponder) which may optionally reply by data by charge modulation to the first circuit. Each REID circuit has its antenna operating at its natural resonance frequency.

As a general rule, the problems with RFID antenna circuits relate to the efficiency of the magnetic antenna of the transponder and reader i.e. to the efficiency of coupling by mutual inductance between the two magnetic antennas, to the transmission of energy and information between the electronic part and its antenna, and to the transmission of energy and information between the two antennas of the RFID system.

The chief objective is to gain in radio efficiency (emitted or captured magnetic field power, coupling, mutual inductance, etc.) by the antenna without losing any signal quality (data distortion, antenna bandwidth, etc.) whether emitted or received.

Antennas with reduced surface areas (30×30 mm) are becoming increasingly more seen, even largely reduced surface areas (5×5 mm) for applications such as cards or μCards, stickers, small readers, option or detachable readers in mobile telephony, in USB keys, in SIM cards.

In addition to a reduced (<16 $cm^2$) or largely reduced (<4 $cm^2$) surface area, very often there are very strong mechanical or electric constraints such as the presence of a battery, a screen or display, a conductor support in the field very close to the antenna.

These various electric and mechanical constraints on the surface lead to reduced efficiency of the antenna, to loss of coupling efficiency, to loss of signal power emitted or received by the antenna, and to reduced communication distance or reduced transmission of energy or information.

For antennas of reasonable size (>16 $cm^2$) as for antennas of reduced (<16 $cm^2$) or largely reduced (<4 $cm^2$) surface area, increasingly greater needs are being encountered regarding the need for power on the emitted or captured magnetic field, the bandwidth of the radio channel to meet ever increasing data rates and standards in force such as ISO 14443 (e.g. for transport, identity, etc.), ISO 15693 (e.g. for tags) and RFID/NFC specifications for the banking sector (EMVCO).

Document U.S. Pat. No. 7,212,124 for example describes an information device for mobile telephone, comprising an antenna coil formed on a substrate, a sheet of magnetic material, an integrated circuit and resonance capacitors connected to the antenna coil. The integrated circuit communicates with an outside apparatus through use by the antenna coil of a magnetic field. A depression serving as a battery receiving section is formed on one part of the surface of the case and covered by the battery cover. The battery, antenna coil and sheet of magnetic material are housed in the depression. A film of vacuum evaporated metal or a conductive material coating is applied to the case, while no film of vacuum evaporated metal or coating of conductive material is applied to the battery cover. The antenna coil is arranged between the battery cover and the battery, whilst the sheet of magnetic material is arranged between the antenna coil and the battery in the depression. The antenna coil has an intermediate tap, the resonance capacitors are connected to both ends of the antenna coil, and the integrated circuit is connected in the centre between one of the ends of the antenna coil and the intermediate tap.

This device has numerous disadvantages.

It only functions in mobile telephones. On account of the presence of a battery, the antenna must have a very high quality factor before its integration. However, a quality factor having such a high value is not suitable for RFID/NFC antenna circuits, readers or transponders (cards, tags, USB keys). In a mobile telephone, the reason this high value quality factor exists is that electric and mechanical constraints overwhelm the original quality factor of the antenna. For conventional applications or without these constraints, this quality coefficient of the antenna would be too high and would generate a much reduced antenna bandwidth at −3 dB, hence very severe filtering of the modulated emitted or received HF signal through charge modulation (subcarrier of 13.56 MHz at ±847 kHz, ±424 kHz, ±212 kHz, etc.) and too high emitted or received power. Also the coupling with said antenna, again for conventional applications or without these constraints, would be such that at a short distance between the 2 antennas (<2 cm for example) the mutual inductance created would be such that it would fully mistune the frequency tuning of the two antennas, would cause the power radiated by the reader to collapse, could saturate the radio stages of the silicon chip and even lead to possible destruction of the transponder silicon, this silicon not having infinite calorific dispersion capacity.

Therefore document US-A1-2008/0150693 for example describes an antenna device essentially for reader mode operation. It has a conventional arrangement of a series inductance, an arrangement of two parallel inductances and finally an arrangement of two series inductances with a third inductance parallel to one of the two series inductances. The embodiments proposed notably require two different surfaces, one large and one small, either on the same inductance or on two inductances. The objective of the two latter embodiments is to allow amplification of the signal emitted in the centre of the antenna by a small parallel inductance, and in a third embodiment, to eliminate radiation holes over a location lying between the arrangement of the two antenna surfaces.

One of the disadvantages of the antenna device according to document US-A1-2008/0150693 is that it cannot be integrated into an embossed card. Another disadvantage is that the coupling of this device in read mode with another antenna does not meet the ideal conditions to obtain optimum coupling with a transponder.

Documents EP-A-1,031,939 and FR-A-2,777,141 describe an antenna circuit device for transponder mode operation having two electrically independent antenna circuits. In the device described in documents EP-A-1,031,939 and FR-A-2,777,141, a first antenna circuit consists of a conventional inductance and the transponder chip. A second antenna circuit consists of a coil winding forming an inductance associated with a planar capacitance called a "resonator". The objective of the two embodiments is to allow amplification of the electromagnetic signal received by the "resonator" arrangement for the first antenna circuit comprising the transponder.

This device according to EP-1,031,939 and FR-2,777,141 has the disadvantage of coupling that is much too strong, without guaranteeing the efficiency of increased read distance. Worse still, when coupling efficiency is extremely strong, RFID communication between the reader and the transponder does not take place.

Additionally, the same remarks as for document U.S. Pat. No. 7,212,124 can be made. With a conventional "resonator" circuit, coupled by mutual inductance with a first antenna circuit comprising the transponder, the relationship is quasi-linear, to make things simple, between, firstly, the efficiency of reading distance or efficiency of electromagnetic field capture and, secondly, the surface of the 2 antenna circuits, their proximity, and their frequency tuning.

The advantage of the embodiments described in documents EP-A-1,031,939 and FR-A-2,777,141 is that maximum efficiency is obtained between the 2 antenna circuits, hence the greatest possible quality coefficient. We therefore arrive at the same remarks as for document U.S. Pat. No. 7,212,124.

Document EP-A-1,970,840 describes a device comparable with the two preceding devices described in documents EP-A-1,031,939 and FR-A-2,777,141, in that 2 resonators are used to amplify the received electromagnetic field. The same remarks therefore apply as previously made. In addition, the constraints indicated for documents EP-A-1,031,939 and FR-A-2,777,141 are all the higher and more difficult to overcome since the two resonators lie close to one another.

On the other hand, document U.S. Pat. No. 3,823,403 describes a tri-dimensional loop antenna which is used especially for VHF (from 30 MHz to 300 MHz), which is formed by a length of conductor, ideally by tubes, which is coiled into two or more turns and which is mounted and linked in its intrinsic design and operating for an aircraft by external currents carried by its support and or its structure over a conducting ground plane or metallic structure or in a cavity which may be air filled or loaded with a ferrite or a dielectric on an aircraft.

The length of this tri-dimensional VHF antenna for aircraft is close to the wavelength or the quarter wavelength like the standard antennas for VHF frequencies, in order to come the closest as possible to the desired resonance frequency. This tri-dimensional VHF antenna for aircraft is dedicated to high powers and allows to improve the electromagnetic radiation pattern compared to standard loop antennas or stub antennas or dipole antennas, especially by rising the length of the antenna.

This tri-dimensional VHF antenna for aircraft has no mechanical constraints about a planar design or very small volume to conform to integration in environments of often very small width. This tri-dimensional VHF antenna for aircraft has no electric and radiofrequency constraints about coupling, mutual inductance, decreasing of the near magnetic field, filtering of modulated data, self-feeding or feeding by external fields, and of load modulating, which are the own criterias and constraints of small RFID/NFC antennas at for example 13.56 MHz.

To increase the transmission of emitted or received energy by the antenna, it is possible to add an amplifier in the radio transmission or receiving chain, but this adds to the financial cost and available energy and entails probable distortion on the modulated HF signal.

It is also possible to increase the level of the signal emitted by the silicon, but this is often limited by integration, technological choices, and size.

It is also possible to reduce the internal consumption of the silicon, but current needs for signal cryptography safety, ever increasing memory capacity, and speed of task execution mean that the trend is more in the direction of increased energy consumption.

To increase the emitted or captured magnetic field, coupling, mutual inductance, it is also possible to increase considerably the number of antenna turns. This would increase the inductance of the antenna, the number of turns facing the antenna to be coupled, and hence mutual inductance and coupling. With very close distances between the 2 antennas (<2 cm) this is not an ideal solution either, since the mutual inductance would be very high, and would lead to ill-functioning of the RFID systems by introducing a very high quality coefficient Q and hence a very low bandwidth. For long distance operation (>15 cm) it would be an almost ideal solution, but the modulated HF signal would be filtered for RFID/NFC systems.

Finally, it is possible to act on the size of the antenna, but this is a variable which is rarely debatable and is often a constraint.

BRIEF SUMMARY OF THE INVENTION

The invention generally sets out to obtain an antenna circuit having transmission efficiency and improved transmitting conditions.

For this purpose, a first subject of the invention is an RFID antenna circuit comprising:

- an antenna formed by a number of at least three turns, the antenna having a first end terminal and a second end terminal,
- at least two access terminals to connect a charge,
- at least one tuning capacitance for tuning at a prescribed tuning frequency, having a first capacitance terminal and a second capacitance terminal,
- an intermediate tap connected to the antenna and distinct from the end terminals,
- first connection means connecting the intermediate tap to a first of the two access terminals,
- second connection means connecting the second end terminal to the second capacitance terminal, characterized in that it comprises:
- third connection means connecting the first capacitance terminal and the second of the access terminals respectively to a first point of the antenna and to a second point of the antenna, which is connected to the first point of the antenna by at least one turn of the antenna.

According to one embodiment of the invention, said intermediate tap (A) is connected to the first end terminal (D) of the antenna (L) by at least one turn (S) of antenna (L), said intermediate tap (A) being connected to the second end terminal (E) of antenna (L) by at least one turn (S) of antenna (L).

According to one embodiment of the invention (FIGS. 13, 14, 15, 16), the first point (P1) is connected to the intermediate tap (A) by at least one turn of the antenna.

According to one embodiment of the invention (FIGS. 13, 14, 15, 16), the first point (P1) is located at the intermediate tap (A).

According to one embodiment of the invention, the first point (P1) is connected to the first end terminal (D) of the antenna (L) by at least one turn (S) of antenna (L), the first point (P1) being connected to the second end terminal (E) of the antenna (L) by at least one turn (S) of antenna (L).

According to one embodiment of the invention, the first point (P1) is located at the first end terminal (D).

According to one embodiment of the invention, the second point (P2) is located at the first end terminal (D) of the antenna.

According to one embodiment of the invention, the second point (P2) is located at the second end terminal (E) of the antenna.

According to one embodiment of the invention, the second point (P2) is connected to the intermediate tap (A) by at least one turn of the antenna.

According to one embodiment of the invention, the second point (P2) is connected to the first end terminal (D) of the antenna (L) by at least one turn (S) of the antenna (L), the second point (P2) being connected to the second end terminal (E) of the antenna (L) by at least one turn (S) of the antenna (L).

According to one embodiment of the invention, the first point (P1) is located at the intermediate tap (A) of the antenna (L), and the second point (P2) is located at the first end terminal (D) of the antenna (L).

According to one embodiment of the invention, said first and second points (P1, P2) are separate from the first intermediate tap (A), the first point (P1) being connected to the first end terminal (D) of the antenna (L) by at least one turn (S) of the antenna (L), the first point (P1) being connected to the second end terminal (E) of the antenna (L) by at least one turn (S) of the antenna (L).

According to one embodiment of the invention (FIGS. 13, 14), the second point (P2) is located at the first end terminal (D) of the antenna, the first point (P1) is connected to the intermediate tap (A) by at least one turn of the antenna.

According to one embodiment of the invention, said intermediate tap (A) forms a first intermediate tap (A), the first intermediate tap (A) being connected to the first end terminal (D) of the antenna (L) by at least one turn (S) of the antenna (L), the first intermediate tap (A) being connected to the second end terminal (E) of the antenna (L) by at least one turn (S) of the antenna (L), the second point (P2) is located at a second intermediate tap (P2) of the antenna (L), the second intermediate tap (P2) being connected to the first end terminal (D) of the antenna (L) by at least one turn of the antenna (L), the second intermediate tap (P2) being connected to the second end terminal (E) of the antenna (L) by at least one turn (S) of the antenna (L).

According to one embodiment of the invention, the capacitance comprises a first metal surface forming the first capacitance terminal (C1X), a second metal surface forming the second capacitance terminal (C1E), at least one dielectric layer lying between the first metal surface and the second metal surface.

According to one embodiment of the invention, the capacitance comprises at least one dielectric layer having a first side and a second side distant from the first side, a first metal surface forming the first capacitance terminal (C1X) on the first side of the dielectric layer, a second metal surface forming the second capacitance terminal (C1E) on the second side of the dielectric layer, a third metal surface forming a third capacitance terminal (C1F) lying away from the first metal surface on the first side of the dielectric layer, the first capacitance terminal (C1X) defining a first capacitance value (C2) with the second capacitance terminal (C1E), the third capacitance terminal (C1F) defining a second capacitance value (C1) with the second capacitance terminal (C1E), the first capacitance terminal (C1X) defining a third coupling capacitance value (C12) with the third capacitance terminal (C1F), connection means connecting the third capacitance terminal (C1F) to one of the access terminals (1, 2).

According to one embodiment of the invention, the antenna (L) comprises at least one first turn (S1), at least one second turn and at least one third turn, which are consecutive, the first turn (S1) extending from the second end terminal (E) in a first winding direction to a reversal point (PR) connected to the second turn, the second and third turns (S2, S3) extending from said reversal point (PR) to the first end terminal (D) in a second winding direction which is the reverse of the first winding direction, the first point (P1) of the antenna (L) and the second point (P2) of the antenna (L) being located on the second and third turns (S2, S3).

According to one embodiment of the invention, the antenna (L) comprises at least one first turn (S1) and at least one second turn (S2, S3) consecutive between two third and fourth points (E; D) of the antenna, the first turn (S1) being connected to the second turn (S2, S3) by a reversal point (PR), the first turn (S1) extending from the third point (E) to the reversal point (PR) in a first winding direction, the second turn (S2, S3) extending from said reversal point (PR) to the fourth point (D) in a second direction of winding which is the reverse of the first winding direction.

According to one embodiment of the invention (FIGS. 12, 31, 32), the antenna (L) comprises at least one first turn (S1) and at least one second turn (S2, S3) consecutive between two third and fourth points (E; D) of the antenna, the first turn (S1) being connected to the second turn (S2, S3) by a reversal point (PR), the first turn (S1) extending from the third point (E) to the reversal point (PR) in a first direction of winding, the second turn (S2, S3) extending from said reversal point (PR) to the fourth point (D) in a second direction of winding which is the reverse of the first direction of winding, the first point (P1) is located at the intermediate tap (A) of the antenna (L) and the second point (P2) is located at the first end terminal (D) of the antenna (L).

According to one embodiment of the invention (FIGS. 15, 17), the antenna (L) comprises at least one first turn (S1) and at least one second turn (S2, S3) consecutive between two third and fourth points (E; D) of the antenna, the first turn (S1) being connected to the second turn (S2, S3) by a reversal point (PR), the first turn (S1) extending from the third point (E) to the reversal point (PR) in a first direction of winding, the second turn (S2, S3) extending from said reversal point (PR) to the fourth point (D) in a second direction of winding which is the reverse of the first direction of winding, the first point (P1) is located at the first end terminal (D).

According to one embodiment of the invention, at least one turn (S2) of the antenna comprises in series a winding (S2') of turns of smaller surrounded surface with respect to the surface surrounded by the remainder (S2") of said turn (S2) or with respect to the surface surrounded by other turns of the antenna (3).

According to one embodiment of the invention, the turns (S) of the antenna (3) are distributed over several separate physical planes.

According to one embodiment of the invention, the tuning capacitance (C1) comprises a second capacitance (ZZ) formed by at least one third turn (SC3) comprising two first and second ends (SC31, SC32) and by at least one fourth turn (SC4) comprising two first and second ends (SC41, SC42), the third turn (SC3) being electrically separated from the fourth turn (SC4) to define at least the tuning capacitance (C1) between the first end (SC31) of the third turn (SC3) and the second end (SC42) of the fourth turn (SC4), the first end (SC31) of the third turn lying further distant from the second end (SC42) of the fourth turn (SC4) than from the first end (SC41) of the fourth turn (SC4), the second end (SC32) of the third turn (SC3) lying further distant from the first end (SC41) of the fourth turn (SC4) than from the second end (SC42) of the fourth turn (SC4), the second capacitance being defined between the first end (SC31) of the third turn (SC3) and the second end (SC42) of the fourth turn (SC4).

According to one embodiment of the invention, there is at least one turn (S1) of the antenna between the intermediate tap (A) and the second capacitance.

According to one embodiment of the invention, first coupling means are provided to ensure coupling (COUPL12) by mutual inductance between firstly the at least one turn (S2) of the antenna electrically connected in parallel with the first and second access terminals (1, 2) and secondly the other at least one turn (S1) of the antenna, second coupling means are provided to ensure coupling (COUPLZZ) by mutual inductance between said other at least one turn (S1) of the antenna and the at least one third and fourth turns (SC3, SC4) of the second capacitance (ZZ).

According to one embodiment of the invention, the first coupling means are formed by the proximity between, firstly, the at least one turn (S2) of the antenna electrically connected in parallel with the first and second access terminals (1, 2) and, secondly, the other at least one turn (S1) of the antenna, the second coupling means are formed by the proximity between said other at least one turn (S1) of the antenna and the at least one third and fourth turns (SC3, SC4) of the second capacitance (ZZ).

According to one embodiment of the invention, the third turn (SC3) and the fourth turn (SC4) are interleaved.

According to one embodiment of the invention, the third turn (SC3) comprises at least one third section, the fourth turn (SC4) comprises a fourth section, the third section lying adjacent the fourth section.

According to one embodiment of the invention, the sections extend parallel to each other.

According to one embodiment of the invention, the tuning capacitance (C1) comprises a first capacitance (C1) comprising a dielectric between the first capacitance terminal (C1X) and the second capacitance terminal (C1E), the first capacitance (C1) being made in the form of a wire, etched, discrete, or printed element.

According to one embodiment of the invention (FIGS. 16, 18), another capacitance (C30) is connected between the second end terminal (E) and a point (PC1) of the antenna which is connected to the second point (P2) by at least one turn of the antenna.

According to one embodiment of the invention (FIGS. 20, 22), the tuning capacitance (C1) comprises a first capacitance (C30) in series with said second capacitance (Z).

According to one embodiment of the invention (FIG. 22), the first capacitance (C30) is connected between the second end terminal (E) of the antenna and the second point (P2) which is connected to the first terminal (SC31) of the third turn (SC3), the intermediate tap (A) being connected to the second terminal (SC42) of the fourth turn (SC4) which forms the first point (P1), the first terminal (SC41) of the fourth turn (SC4) forming the first end terminal (D) of the antenna.

According to one embodiment of the invention (FIG. 20), the first capacitance (C30) is connected between the second end terminal (E) of the antenna and the second point (P2) which is connected to the first terminal (SC31) of the third turn (SC3) by at least one turn (S10), the intermediate tap (A) being connected to the second terminal (SC42) of the fourth turn (SC4) which forms the first point (P1), the first terminal (SC41) of the fourth turn (SC4) forming the first end terminal (D) of the antenna.

According to one embodiment of the invention (FIG. 21), the first point (P1) is located at the intermediate tap (A), the second point (P2) is located at the second end terminal (E) of the antenna.

According to one embodiment of the invention (FIG. 19), the first point (P1) is located at the first end terminal (D) and the second point (P2) is located at the second end terminal (E).

According to one embodiment of the invention, the at least one third turn (SC3) and the at least one fourth turn (SC4) define a second sub-circuit having a second natural resonance frequency, the first and second access terminals (1, 2), together with a module (M) connected to them and with at least one turn (S2) connected to said first and second access terminals (1, 2), define a first sub-circuit having a first natural resonance frequency, the turns being arranged so that frequency difference between the first natural resonance frequency and the second natural resonance frequency is equal to or less than 10 MHz.

According to one embodiment of the invention, the at least one third turn (SC3) and the at least one fourth turn (SC4) define a second sub-circuit having a second natural resonance frequency, the first and second access terminals (1, 2) together with a module (M) connected to them and with at least one turn (S2) connected to said first and second access terminals (1, 2) define a first sub-circuit having a first natural resonance frequency, the turns being arranged so that the frequency difference between the first natural resonance frequency and the second natural resonance frequency is equal to or less than 500 KHz.

According to one embodiment of the invention, the at least one third turn (SC3) and the at least one fourth turn (SC4) define a second sub-circuit having a second natural resonance frequency, the first and second access terminals (1, 2) together with a module (M) connected to them and with at least one turn (S2) connected to said first and second access terminals (1, 2) define a first sub-circuit having a first natural resonance frequency, the turns being arranged so that the first natural resonance frequency and the second natural resonance frequency are substantially equal.

According to one embodiment of the invention (FIGS. 29, 30), the antenna comprises a mid-point (PM) to set a potential at a reference potential, with an equal number of turns on the section extending from the first end terminal (D) to the mid-point (PM) and on the section extending from the mid-point (PM) to the second end terminal (E).

According to one embodiment of the invention, the antenna lies on a substrate.

According to one embodiment the invention, the antenna is a wire.

According to one embodiment of the invention, said terminals (D, E, 1, 2, C1E, C1X), said tap (A), said points (P1, P2) and the capacitance (C1, ZZ) define a plurality of at least three nodes, the nodes defining at least one first group (S1) of at least one turn between two first nodes (1, C1E) separate from each other, and at least one second group of at least one other turn (S2) between two second nodes (1, 2) separate from each other, at least one of the first nodes being different from at least one of the second nodes, first coupling means are provided to ensure coupling (COUPL12) by mutual inductance between the first group (S1) of at least one turn and the second group of at least one other turn (S2) through the fact that the first group (S1) of at least one turn is positioned in the vicinity of the second group of at least one other turn (S2).

According to one embodiment of the invention, said terminals (D, E, 1, 2, C1E, C1X), said tap (A), said points (P1, P2), and the capacitance (C1, ZZ) define a plurality of at least three nodes, the nodes defining at least one first group (S1) of at least one turn between two first nodes (1, C1E) separate from each other, and at least one second group of at least one other turn (S2) between two second nodes (1, 2) separate from each other, and at least one third group of at least one other turn (SC3, SC4) between two third nodes (E, C1X) separate from each other, at least one of the first nodes being different from at least one of the second nodes, at least one of first nodes being different from at least one of the third nodes, at least one of the third nodes being different from at least one of the second nodes, first coupling means are provided to ensure coupling (COUPL12) by mutual inductance between, firstly, the first group (S1) of at least one turn and, secondly, the second group of at least one other turn (S2) through the fact that the first group (S1) of at least one turn is positioned in the vicinity of the second group of at least one other turn (S2), second coupling means are provided to ensure coupling (COUPLZZ) by mutual inductance between firstly the first group (S1) of at least one turn and secondly the third group of at least one other turn (SC3, SC4) through the fact that the first group (S1) of at least one turn is positioned in the vicinity of the third group of at least one other turn (SC3, SC4).

According to one embodiment of the invention, the first group (S1) of at least one turn is positioned between the second group of at least one other turn (S2) and the third group of at least one other turn (SC3, SC4).

According to one embodiment of the invention, the distance separating the turns (S1, S2, SC3, SC4) belonging to different, groups is equal to or less than 20 millimeters.

According to one embodiment of the invention, the distance separating the turns (S1, S2, SC3, SC4) belonging to different groups is equal to or less than 10 millimeters.

According to one embodiment of the invention, the distance separating the turns (S1, S2, SC3, SC4) belonging to different groups is equal to or less than 1 millimeter.

According to one embodiment of the invention, the distance separating the turns (S1, S2, SC3, SC4) belonging to different groups is equal to or more than 80 micrometers.

This is the distance separating the groups of turns (S1, S2).

According to an embodiment of the invention, at least a reader (LECT) as charge and/or at least a transponder (TRANS) as charge is connected to the access terminals (1, 2).

According to an embodiment of the invention, the circuit comprises several first access terminals (1) which are distinct from each other and/or several second access terminals which are distinct from each other.

According to an embodiment of the invention, said at least one first access terminal (1) and said at least one second access terminal (2) are connected to at least one first charge (Z1) having a first prescribed tuning frequency in a high frequency band and at least one second charge (Z2) having a second prescribed tuning frequency in another ultra high frequency band.

Thanks to the invention, it is managed to maintain a reasonable quality factor or to limit its increase (the quality factor being equal to the resonance frequency divided by the bandwidth at −3 dB) in order to maintain a reasonable or scarcely increased bandwidth, whilst maintaining or increasing radiated or received power by the antenna and maintaining or reducing the mutual inductance generated during coupling with the second, external RFID antenna circuit.

In particular, this overcomes the need to limit the antenna to one or two turns as in prior art RFID/NFC readers of reasonable size (>16 $cm^2$) and to 3 or 4 turns for reduced-size antennas (<16 $cm^2$). In prior art RFID/NFC readers provision is made for no more than one or two turns for the antennas of reasonable size (>16 $cm^2$) and for no more than three or four turns for antennas of reduced size (<16 $cm^2$) to guarantee both radiated and received power that is greater than a minimum power and a bandwidth that is greater than a minimum band. In prior art transponders, the number of turns is imposed by the compromise between the antenna surface and silicon capacity and the desired tuning frequency (around 13.56 Mhz up to 20 MHz). For the transponder there is therefore little freedom regarding the number of turns in the antenna, and hence little freedom regarding the radio efficiency of the antenna, hence little freedom regarding action on the quality factor, the captured magnetic field, coupling and the mutual inductance generated during coupling with the second, external RFID antenna circuit.

The circuit of the invention, whether for transmitting or receiving, makes it possible in particular to reduce mutual inductance with the second, external RFID antenna circuit operating in receiver or transmitting mode, since the current density is especially concentrated in the active part of the inductance. By simplifying, for the purpose of technical vulgarization, the mutual inductance between two circuits is proportional to the number of opposite facing turns of the circuit. Reducing mutual inductance limits the perturbation on frequency tuning of the antenna circuits at short distances (<2 cm for example). This reduction in mutual inductance does not take place to the detriment of radiated or received power.

Let us consider these 3 rules, governing an HF RFID/NFC antenna system with a coil winding, known to the person skilled in the art:

The magnetic field (H) is defined by:

$$H = \frac{I \cdot N \cdot R^2}{2\sqrt{(R^2 + x^2)^3}}$$

for circular antennas. N is the number of turns of the antenna, R is the radius of the antenna, and x is the distance from the centre of the antenna in direction x normal to the antenna.

Mutual inductance (M) is defined by:

$$M_{21} = \frac{\mu_0 \cdot N_1 \cdot R_1^2 \cdot N_2 \cdot R_2^2 \cdot \pi}{2\sqrt{(R_2^2 + x^2)^3}}$$

in which N1 is the number of turns of a first antenna and N2 is the number of turns of a second antenna. Mutual inductance is a quantitative description of the flux coupling two conductor loops.

The quality coefficient of the antenna (Q) is defined by:

$$Q = L*2\pi*Fo/Ra = Fo/\text{Bandwidth at } -3 \text{ dB}$$

The coupling coefficient (K) is defined by:

$$k = \frac{M}{\sqrt{L_1 \cdot L_2}}$$

The coupling coefficient (K) introduces a qualitative prediction for the coupling of the antennas independently of their geometric dimensions. L1 is the inductance of a first antenna and L2 is the inductance of a second antenna.

The possibilities of increasing the radio efficiency of a magnetic antenna are described below.

To increase the transmitted or received magnetic field (H), if it is considered that the radius R and the current in the antenna I as imposed, the number N of turns of the antenna must be increased.

To increase the mutual inductance (M) between the 2 antennas, if R1 and R2 are considered to be imposed, then N1 and/or N2 must be increased.

To reduce the quality coefficient (Q) of the antenna, the inductance (L) of the antenna must be reduced and/or the resistance (Ra) of the antenna increased.

To increase coupling (k) between the 2 antennas, the mutual inductance (M) must be increased and/or the inductance L1 and L2 of the 2 antennas must be decreased without decreasing mutual inductance (M).

The problems and parameters related therewith are the following.

It is difficult to increase the global radio efficiency of the antenna without causing detriment to the emitted or captured magnetic field, to coupling, to mutual inductance, and to the bandwidth. For example, by increasing the number of turns, a favourable increase is obtained in inductance, in the magnetic field and in mutual inductance, but the bandwidth is reduced through an increase in the quality coefficient.

To summarize the possible choices:

The radiated or captured magnetic field depends on the number of turns in the antenna. Ideally the number of turns must be increased.

The coupling coefficient is an inverse function of the inductances of the 2 antennas. By reducing the inductance of the antennas, the coupling coefficient between the 2 antennas is increased. Again, ideally, either mutual inductance must be increased or the loss on mutual inductance must be limited.

Mutual inductance is a function of the number of turns of antennas. Therefore, by increasing the number of turns of the antenna, the mutual inductance between the 2 antennas increases. Giving consideration to the coupling coefficient, ideally, the inductances of the antennas must not be increased.

The bandwidth is a function of the inductance of the antenna and the inverse function of the resistance of the antenna. Ideally, therefore, antenna inductance must be reduced and its resistance increased.

To conclude on the magnetic field, the number of turns must be the same or more.

To conclude on the coupling coefficient, mutual inductance must be the same or increased and/or the inductance of the antenna must be reduced.

To conclude on mutual inductance, the number of turns must be the same or increased.

To conclude on the quality coefficient, the inductance of the antenna must be the same or reduced and/or the resistance of the antenna must be increased.

The solution of the invention provides the possibility, using the method of the invention, of parameterizing the distribution of current in the antenna such as, for example, having a different current density in at least 2 turns forming the antenna, therefore not having a uniform current in the antenna and hence having a different current in at least 2 different turns.

By not having a uniform current in the antenna, it is possible to obtain a variation in the value of inductance and resistance between at least 2 turns forming the antenna. Ideally, therefore, it is possible to promote or limit the general value of the inductance of the antenna relative to the value of the general resistance of the antenna, or conversely.

Through the non-uniform distribution of current and variations in direct parameters, it is ideally possible to promote or limit the indirect parameters such as the generated or received magnetic field, mutual inductance, and coupling and their distributions in the space of the antenna.

Therefore, in some embodiments, the circuit comprises means to make the distribution of current non-uniform between the two ends of the antenna.

The fundamental difference can therefore be appreciated between the prior art technique with "conventional" loop antennas in which the antenna consists of N wound turns. In the conventional loop antenna, current is considered to be highly uniform. There are therefore few means for parameterizing or to cause the direct parameters (inductance, antenna resistance, bandwidth) to cross-vary with indirect parameters (transmitted or captured magnetic field, coupling, mutual inductance).

The solution of the invention and the possible embodiments then introduce the concept of a particular arrangement of inductances and capacitances, connection terminals, so-called "active" inductances, so-called "passive" inductances, so-called "negative inductances" allowing ideal use of the transmitted or captured magnetic field, coupling, mutual inductance, and bandwidth.

Finally, a particular arrangement of capacitances with charge or with charge plus inductances or with inductances or with a frequency tuning circuit take part in obtaining the proposed objective.

BRIEF DESCRIPTION OF THE DRAWINGS

The invention will be better understood on reading the following description, given solely as a non-limiting example with reference to the appended drawings in which.

DETAILED DESCRIPTION OF THE INVENTION

In what follows, the antenna circuit can either be a circuit emitting electromagnetic radiation via the antenna, or a circuit which receives electromagnetic radiation via the antenna.

In a first application, the RFID antenna circuit is of transponder type, to function as a portable card, tag, to be integrated in a paper document such as a document issued by an official authority e.g. a passport, USB keys, SIM cards and (U)SIM cards called "RFID or NFC SIM card", stickers for Dual cards or Dual Interface cards (the sticker itself having an REID antenna), watches.

In a second application, the REID antenna circuit is of reader type to read i.e. at least receive the signal radiated by the REID antenna of a transponder such as defined in the first case, such as mobile phones, PDAs, computers.

Generally, the circuit comprises an antenna 3 formed of at least three turns S of a conductor on an insulator substrate SUB. The turns S have an arrangement defining an inductance L having a determined value between a first end terminal D of the antenna 3 and a second end terminal E of the antenna 3.

Figure 1A:
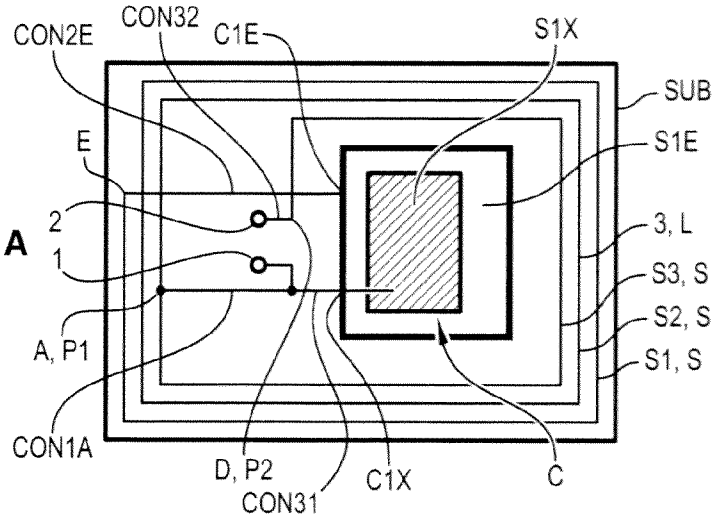
FIGS. 1A, 2A, 3A, 4A illustrate embodiments of the antenna circuit as transponder according to the invention.
Figure 1B:
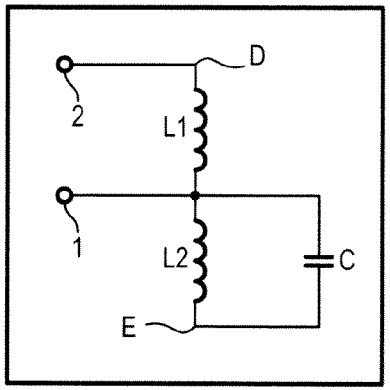
FIGS. 1B, 2B, 3B, 4B show equivalent electric layouts of the circuits in FIGS. 1A, 2A, 3A, 4A, FIGS. 5A, 6A, 7A, 8A, 9A, 11A show embodiments of the antenna circuit as reader according to the invention.

In the embodiment shown FIGS. 1A and 1B, the antenna 3 is formed of three consecutive turns S1, S2, S3 from the outer end terminal E to the inner end terminal D.

A first access terminal 1 is connected by a conductor CON1A to an intermediate tap or intermediate point A of antenna 3 between its end terminals D, E.

A tuning capacitance C at a prescribed tuning frequency i.e. a resonance frequency e.g. of 13.56 MHz up to 20 MHz is provided in combination with the inductance L of the antenna 3.

The second end terminal E of antenna 3 is connected via a conductor CON2E to the second terminal C1E of the capacitance C.

The first terminal C1X of the capacitance C is connected via conductor CON31 to the intermediate tap A forming a first point P1 of the antenna 3.

A second access terminal 2 is connected via a conductor CON32 to the first end terminal D forming a second point P2 of the antenna 3. Point P2 is different from point A.

The two access terminals 1, 2 serve to connect a charge.

According to the invention, there is at least one turn S between the first point A, P1 and the second point P2.

The intermediate tap A, P1 is connected to the end terminal D by at least one turn S of the antenna L i.e. a turn S3 in FIG. 1. The intermediate tap A, P1 is connected to the second end terminal E of antenna L by at least one turn S of antenna L, i.e. two turns S1 and S2 in FIG. 1, in which the intermediate tap A is located between the turns S3 and S2.

Generally, according to the invention, points D, E, 1, 2, A, C1E, C1X, P1, P2 form electric nodes of the circuit. The points directly connected together form the same node, for example when the connection means are electric conductors. Two separate nodes are connected by at least one turn.

In the equivalent schematic shown FIG. 1B, the circuit in FIG. 1A, the circuit in FIG. 1A has a first inductance L1 called an active inductance formed by the third turn S3 between the access terminals 1, 2. Between the intermediate tap A and terminal E, there is a second inductance L2, called passive inductance, formed by the first turn S1 and the second turn S2. The second inductance L2 lies parallel with the capacitance C between the intermediate tap A and terminal E. The sum of the first inductance L1 and second inductance L2 is equal to the total inductance L of the antenna 3. Evidently, the antenna 3 has a resistance in series with its inductance L and inter-turn coupling capacitances which are not shown in all the figures.

The capacitance C may be of any type of technology and using any fabrication method. In the example in FIG. 1A, the capacitance C is of planar type being arranged on the free region of the substrate in the centre of the turns C. In FIG. 1A, the capacitance C is formed of a capacitor having a first metal surface SIX forming the first capacitance terminal C1X, a second metal surface S1E carried by the substrate and forming the second capacitance terminal C1E. One or more dielectric layers are located between the first metal surface SDK and the second metal surface S1E.

The embodiment shown FIGS. 1A and 1B makes it possible to increase the efficiency of the antenna 3.

Figure 2A:
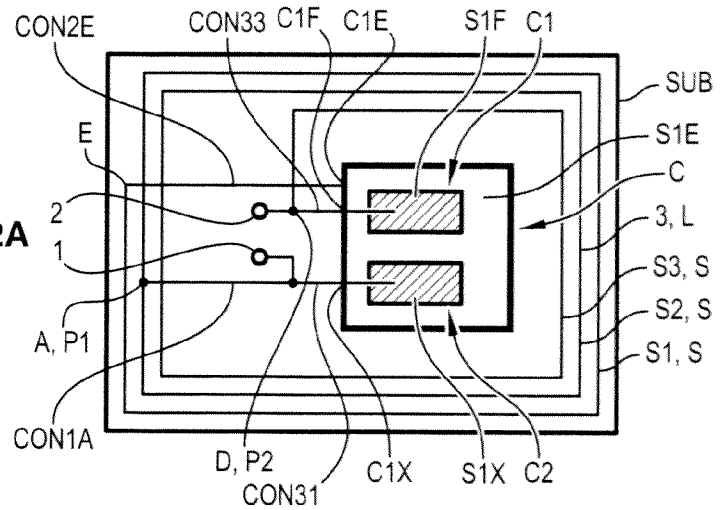
Figure 2B:
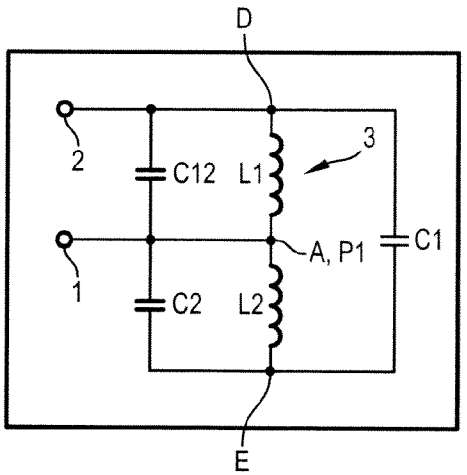

The embodiment shown FIGS. 2A and 2B is a variant of the embodiment shown FIGS. 1A and 1B.

In FIGS. 2A and 2B, the intermediate tap A, P1 is located between the turns S1 and S2. The intermediate tap A, P1 is connected to the end terminal D by at least one turn S of the antenna L, i.e. two turns S2 and S3. The intermediate tap A, P1 is connected to the second end terminal E of antenna L by at least one turn S of the antenna L i.e. a turn S1.

The capacitance C is formed of a capacitor with one or more dielectric layers having a first side and a second side distant from the first side. The first metal surface S1X forms the first capacitance terminal C1X on the first side of the dielectric layer. A second metal surface S1E forms the second capacitance terminal C1E on the second side of the dielectric layer. The first metal surface S1X, together with the second metal surface S1E, defines a capacitance value C2.

A third metal surface S1F forms a third terminal C1F of the capacitance C. The third metal surface S1F is located on the same first side of the dielectric layer as the first metal surface SIX but distanced away from this first metal surface SIX. The third capacitance terminal C1F is connected by a conductor CON33 to the end terminal D. The third metal surface S1F, together with the second metal surface S1F, defines a capacitance value C1.

The third metal surface S1F is coupled to the first metal surface SIX through the fact that they share the same reference terminal C1E formed by surface S1F, to form a coupling capacitance called C12.

In the equivalent schematic shown FIG. 2B, the circuit in FIG. 2A has a first inductance L1 called active inductance, formed by the second turn S2 and the third turn S3, between the access terminals 1, 2. Between the intermediate tap A and terminal E, there is a second inductance L2, called passive inductance, formed by the first turn S1. The sum of the first inductance L1 and the second inductance L2 is equal to the total inductance L of the antenna 3.

The second inductance L2 lies parallel with the capacitance C2 between the intermediate tap A and the terminal E.

The first inductance L1 lies parallel with the coupling capacitance C12.

Capacitance C1 is connected firstly to terminal D and secondly to terminal E.

The embodiment shown FIGS. 2A and 2B makes it possible to further increase the radio efficiency of the antenna 3, on account of the arrangement of the capacitance C1 and C2 and of the coupling between the capacitances C1 and C2.

Figure 3B:
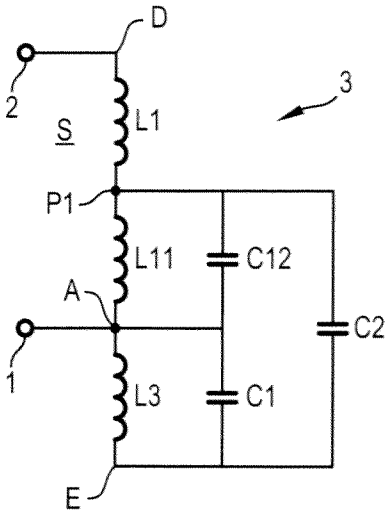
Figure 3A:
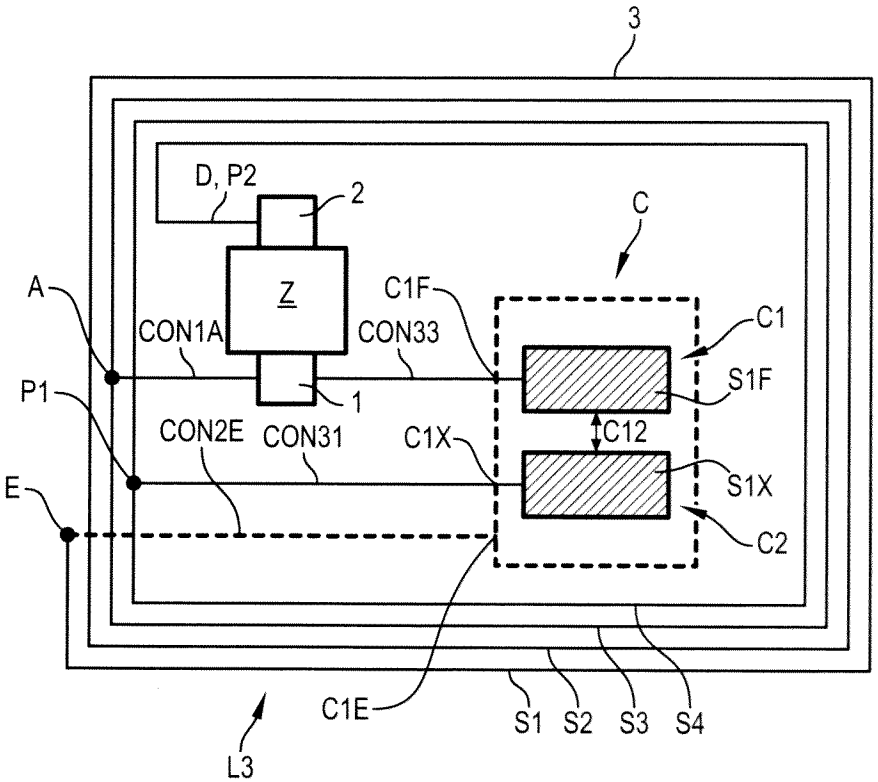

The embodiment shown FIGS. 3A and 3B is a variant of the embodiment shown FIGS. 2A and 2B. In the embodiment shown FIGS. 3A and 3B, the first point P1 is separate from the first intermediate tap A and is distanced from this first intermediate tap A by at least one turn S. The antenna 3 is formed by four consecutive turns S1, S2, S3, S4, from outer end terminal E to inner end terminal D. Also, for example, in FIGS. 3A and 3B the capacitance C is of the type shown in FIGS. 2A and 2B.

The first intermediate tap A is located between turns S2 and S3. The first intermediate tap A is connected to end terminal D by at least one turn S of the antenna L, i.e. the two turns S3 and S4. The intermediate tap A is connected to the second end terminal E of the antenna L by at least one turn S of the antenna L i.e. the two turns S2 and S1.

The access terminal 1 is connected to the first intermediate tap A by the conductor CON1A.

The access terminal 2 is connected to terminal D which is not connected to terminal C1F.

Between the access terminals 1, 2 there is a charge Z. The charge Z may for example be a chip globally designated as "silicon". This chip may also be generally present between the access terminals.

The terminal C1X is connected by conductor CON31 to a first point P1 of the antenna 3, separate from its terminals D, E.

The first point P1 is located between turns S3 and S4. The first point P1 is connected to end terminal D by at least one turn S of the antenna L, i.e. turn S4. The first point P1 is connected to the second end terminal E of antenna L by at least one turn S of antenna L i.e. the three turns S3, S2 and S1.

Terminal D forms the second point P2.

According to the invention, there is at least one turn S between the first point P1 and the second point P2 i.e. turn S4.

The third capacitance terminal C1F is connected by a conductor CON33 to the access terminal 1.

The terminal C1E is connected by a conductor CON2E to terminal E.

In the equivalent schematic shown FIG. 3B, the circuit of FIG. 3A has a first inductance L1 called active inductance formed by turn S4 between terminal 2 and point P1. Between point P1 and tap A, there is a second inductance L11 also said to be active, formed by turn S3.

Between the intermediate tap A and terminal E there is a third inductance L3, called passive inductance, formed by the two turns S2 and S1. The sum of the first inductance L1 and second inductance L11 and third inductance L3 is equal to the total inductance L of the antenna 3.

The third inductance L3 lies parallel with the capacitance C1 between the intermediate tap A and terminal E.

The second inductance L11 lies parallel with the coupling capacitance C12.

Capacitance C2 is connected firstly to point P1 and secondly to terminal E.

Evidently, capacitance C could be of the type shown FIG. 1A, i.e. instead of having C1 and C12, only having capacitance C between P1 and E in FIGS. 3A and 3B.

The embodiment shown FIGS. 3A and 3B makes it possible to increase the efficiency of antenna 3 on account of the arrangement and combination of the "active" and "passive" inductances and capacitances.

Figure 4B:
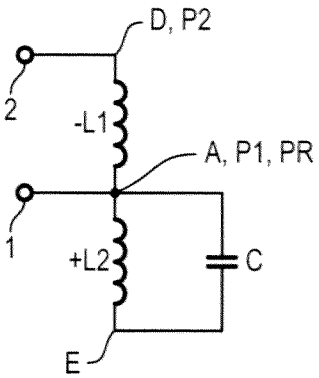
Figure 4A:
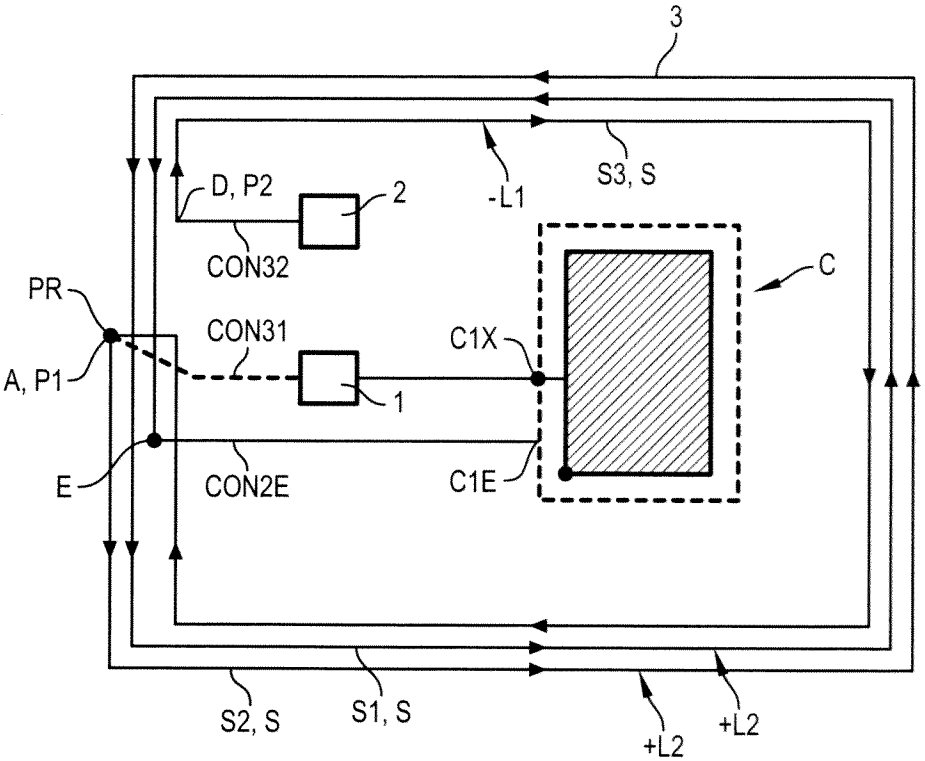

The embodiment shown FIGS. 4A and 4B is a variant of the embodiment shown FIGS. 1A and 1B. In FIGS. 4A and 4B, the antenna 3 is formed from the second end terminal E to the first terminal D by a first turn S1, a second turn S2 and a third turn S3 which are consecutive. Turns S1 then S2 extend from the second end terminal F to a reversal point PR in a first direction of winding, which in FIG. 4A corresponds to a clockwise direction. Turn S3 extends from reversal point PR to the first end terminal D in a second direction of winding opposite the first winding direction, and hence in anti-clockwise direction in FIG. 4A. For example, inner turn S1 extends in opposite direction compared with outer turns S2 and S3.

The first point P1 forming a first intermediate tap A of the antenna connected to the access terminal 1 is located at the reversal point PR.

According to the invention, there is at least one turn S between the first point P1, A and the second point P2.

It is considered that the positive direction of current in the antenna 3 is the direction extending from reversal point PR to terminal E, coinciding in this example with the largest number of turns extending in the same direction, as indicated by the arrows drawn on the antenna 3. The arrows drawn on turns S1 and S2 correspond to this positive direction of the current.

In the equivalent schematic FIG. 4B, the circuit in FIG. 4A has a second positive inductance +L2 called passive inductance and formed by turns S2 and S1.

On account of the reversal point PR, there is a first negative inductance −L1, called active inductance, lying between the intermediate tap A, P1 and terminal D and formed by the third turn S3 between points P1 and P2.

The sum of the first inductance L1 in absolute value and of the second inductance L2 is equal to the total inductance L of the antenna 3.

The negative inductance −L1 makes it possible to further reduce the mutual inductance generated by the antenna 3.

Figure 5B:
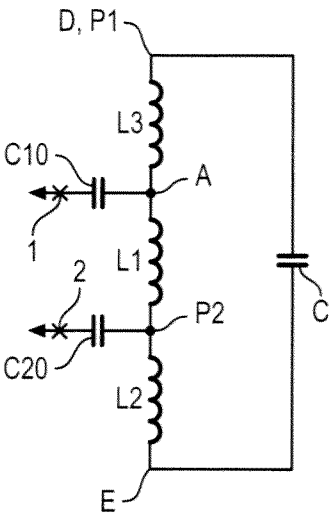
FIGS. 5B, 6B, 7B, 8B, 9B, 11B show equivalent electric layouts of the circuits in FIGS. 5A, 6A, 7A, 8A, 9A, 11A.
Figure 5A:
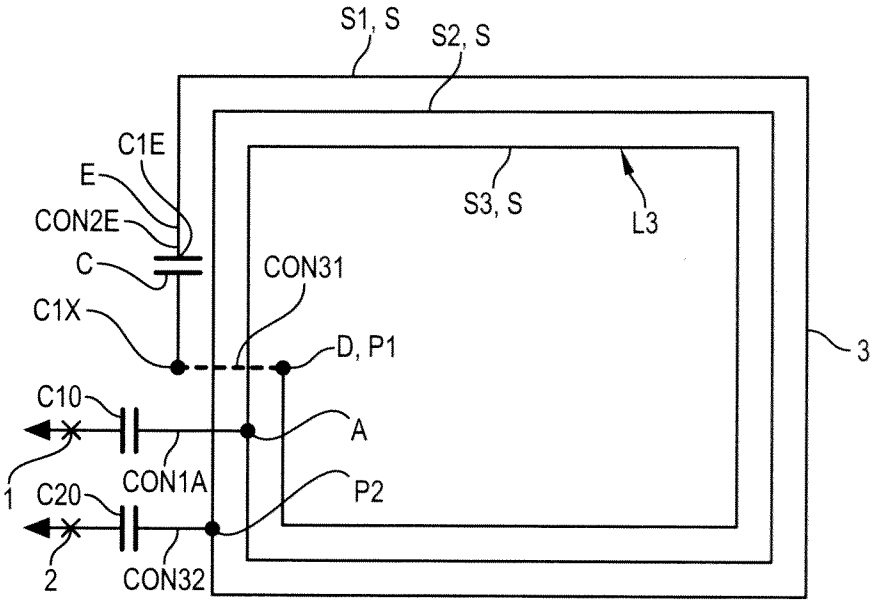

The embodiment shown FIGS. 5A and 5B is a variant of the embodiment shown FIGS. 1A and 1B. In FIGS. 5A and 5B, the antenna 3 is formed by three consecutive turns S1, S2, S3 from outer end terminal E to inner end terminal D, forming the first point P1 of the antenna.

A first access terminal 1 is connected by connection means CON1A to a first intermediate tap A of antenna 3 between its end terminals D, E. The connection means CON1A is a capacitance C10 for example.

The second access terminal is connected by connection means CON32 to a second intermediate tap P2 forming a second point P2 of antenna 3. The connection means CON32 is a capacitance C20 for example.

A tuning capacitance C at a prescribed tuning frequency i.e. a resonance frequency of 13.56 MHz for example is provided in combination with the inductance L of the antenna 3.

The second end terminal E of the antenna 3 is connected by a conductor CON2E to the second terminal C1E of capacitance C.

The first terminal C1X of capacitance C is connected by a conductor CON31 to terminal D, P1 of the antenna 3.

The two access terminals 1, 2 serve to connect a charge.

According to the invention, there is at least one turn S between the first point P1 and the second point P2 i.e. turn S3 and turn S2 in the illustrated embodiment.

The intermediate tap A is located between turns S3 and 32. The intermediate tap 22 is located between turns S1 and S2. The intermediate tap A is connected to end terminal D by at least one turn S of the antenna L, i.e. turn S3 in the illustrated embodiment. The intermediate tap A is connected to the second end terminal E of the antenna L by at least one turn S of the antenna L i.e. two turns S1 and S2 in the illustrated embodiment.

The intermediate tap P2 is connected to end terminal D by at least one turn S of the antenna L i.e. turn S2 and turn S3 in the illustrated embodiment. The intermediate tap P2 is connected to the second end terminal E of antenna L by at least one turn S of the antenna L i.e. turn S1 in the illustrated embodiment.

In the equivalent schematic shown FIG. 5B, the circuit of FIG. 5A has a first inductance L1, called active inductance, formed by the second turn S2 between points A and P2. Between the intermediate tap P2 and terminal E there is a second inductance L2, called passive inductance, formed by the first turn S1. Between the intermediate tap A and terminal D, there is a third inductance L3, called passive inductance, formed by the third turn S3.

The sum of the first inductance L1, of the second inductance L2 and of the third inductance L3 is equal to the total inductance of antenna 3.

The embodiment shown FIGS. 5A and 5B makes it possible to increase the efficiency of antenna 3.

Figure 6B:
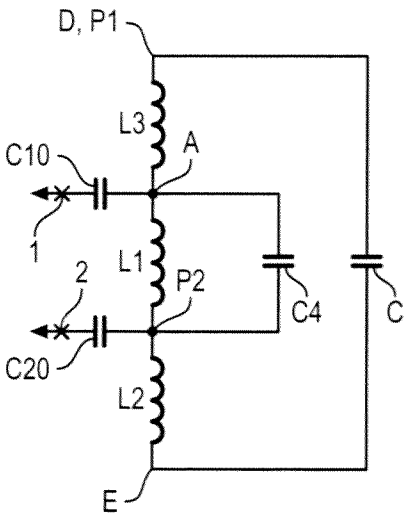
Figure 6A:
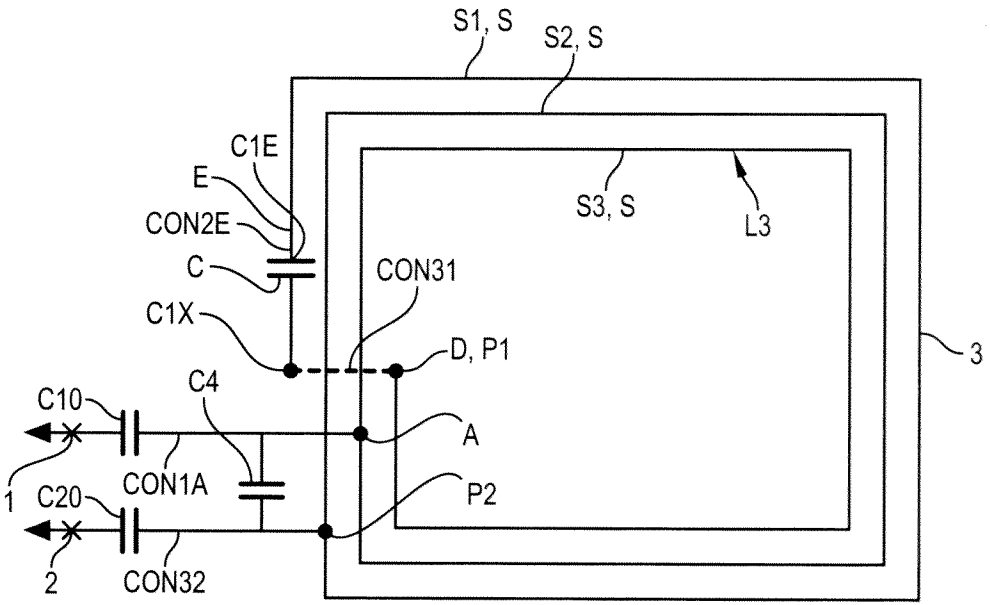

The embodiment shown FIGS. 6A and 6B is a variant of the embodiment given FIGS. 5A and 5B. In FIGS. 6A and 6B, a fourth additional tuning capacitance C4 is connected between the intermediate tap A and the second point P2, parallel with the first inductance L1. The fourth capacitance C4 takes part in frequency tuning with C, in particular on the second inductance L2. The embodiment shown FIGS. 6A and 6B makes it possible to increase the efficiency of the antenna 3.

Figure 7B:
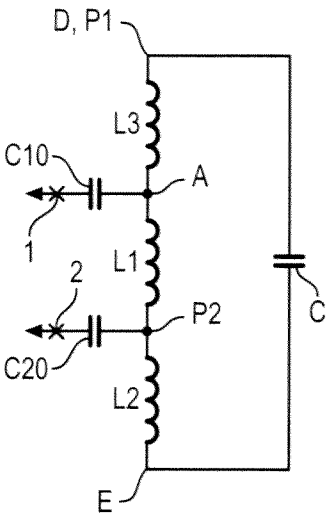
Figure 7A:
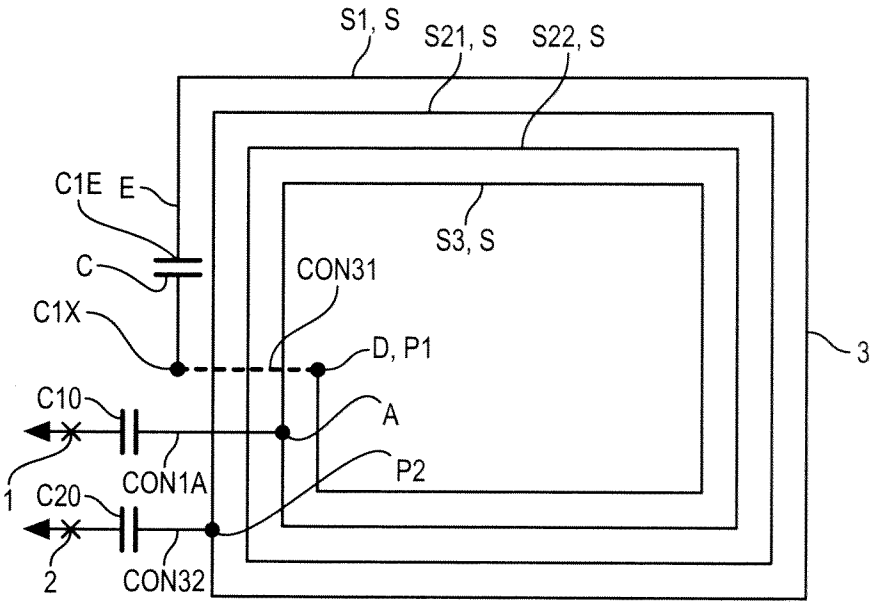

The embodiment shown FIGS. 7A and 7B is a variant of the embodiment shown FIGS. 5A and 5B. In FIGS. 7A and 7B, the antenna 3 is formed by four consecutive turns S1, S21, S22, S3 from outer end terminal F to inner end terminal D.

According to the invention, there is at least one turn S between the first point P1 and the second point P2, namely turn S21, turn S22 and turn S3 i.e. three second turns in the illustrated embodiment. The first point P1 is formed by the end terminal D of the antenna.

The intermediate tap A is located between turns S3 and S22. The intermediate tap P2 is located between turns S1 and S21. The intermediate tap A is connected to the end terminal D by at least one turn S of the antenna L, i.e. turn S3 in the illustrated embodiment. The intermediate tap A is connected to the second end terminal E of antenna L by at least one turn S of the antenna L, i.e. three turns S1, S21 and 522 in the illustrated embodiment. The intermediate tap P2 is connected to end terminal D by at least one turn S of the antenna L, i.e. three turns S21, S22, and S3 in the illustrated embodiment. The intermediate tap P2 is connected to the second end terminal E of the antenna L by at least one turn S of antenna L, i.e. turn S1 in the illustrated embodiment.

In the equivalent schematic in FIG. 7B, the circuit of FIG. 5A has a first inductance L1, called active inductance, formed by the three second turns S21, S22, and S3 between points P1 and P2. Between the intermediate tap P2 and terminal E, there is a second inductance L2, called passive inductance, formed by the first turn S1. Between the intermediate tap A and terminal D, there is a third inductance L3, called passive inductance, formed by the third turn S3.

The sum of the first inductance L1, of the second inductance L2, and of the third inductance L3 is equal to the total inductance L of antenna 3.

The embodiment illustrated FIGS. 7A and 7B makes it possible to increase the efficiency of antenna 3 with a larger number of turns.

Figure 8B:
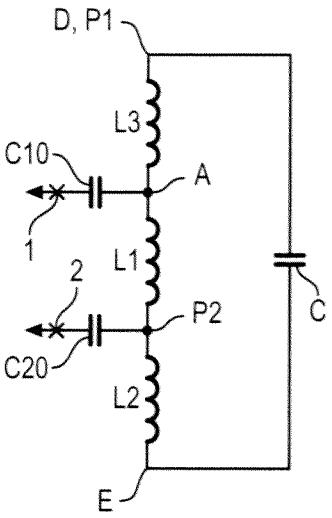
Figure 8A:
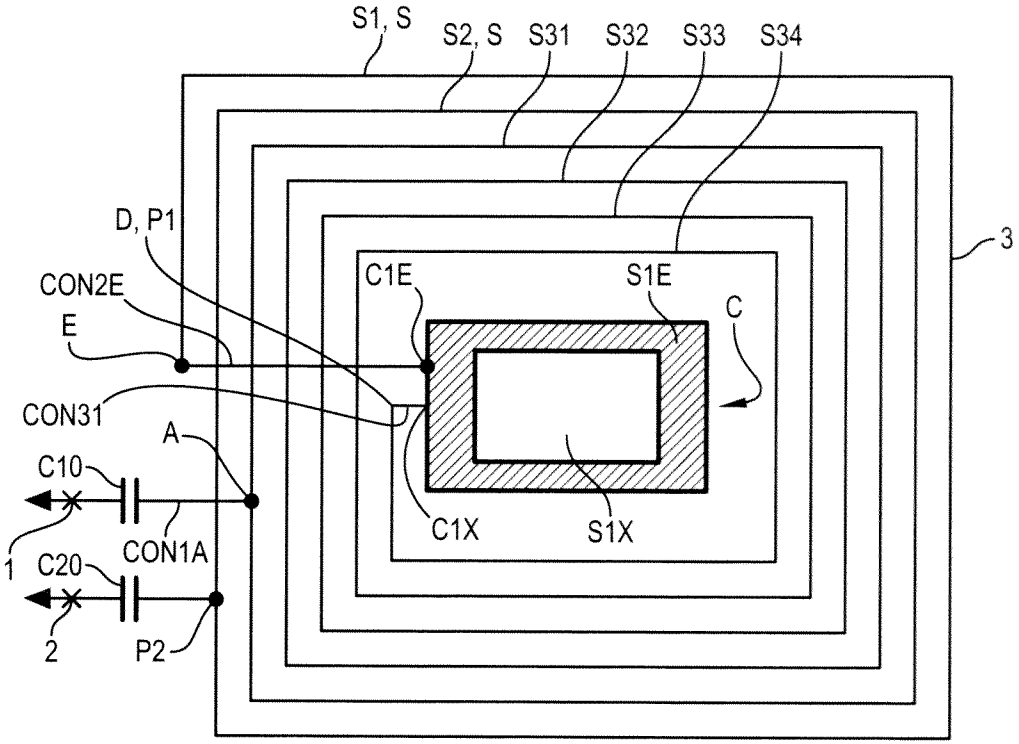

The embodiment shown FIGS. 8A and 8B is a variant of the embodiment shown FIGS. 5A and 5B. In FIGS. 8A and 8B, the antenna 3 is formed by six consecutive turns S1, S2, S31, S32, S33, and S34 from the outer end terminal E to the inner end terminal D. The first point P1 is formed by the end terminal D.

According to the invention, there is at least one turn S between the first point P1 and the second point P2, namely turns S2, S31, S32, S33, and S34 i.e. five second turns in the illustrated embodiment.

The intermediate tap A is located between turns S2 and S31. The intermediate tap P2 is located between turns S1 and S2. The intermediate tap A is connected to the end terminal D by at least one turn S of antenna L, i.e. four turns S31, S32, S33, and S34 in the illustrated embodiment. The intermediate tap A is connected to the second end terminal E of antenna L by at least one turn S of antenna L i.e. the two turns S1, S2 in the illustrated embodiment. The intermediate tap P2 is connected to the end terminal D by at least one turn S of antenna L, i.e. the five turns S2, S31, S32, S33, and S34 in the illustrated embodiment. The intermediate tap P2 is connected to the second end terminal E of antenna L by at least one turn S of antenna L, i.e. turn S1 in the illustrated embodiment.

In the equivalent schematic FIG. 5B, the circuit of FIG. 5A has a first inductance L1, called active inductance, formed by the second turns S2, S31, S32, S33, and S34 between points P1 and P2. Between the intermediate tap P2 and terminal E there is a second inductance L2, called passive inductance, formed by the first turn S1. Between the intermediate tap A and the terminal D, there is a third inductance L3, called passive inductance, formed by the four turns S31, S32, S33, and S34.

The sum of the first inductance L1, of the second inductance L2, and of the third inductance L3 is equal to the total inductance L of the antenna 3.

The embodiment shown FIGS. 8A and 8B makes it possible to increase the efficiency of the antenna 3 with even more turns.

The capacitance C is formed by example of a capacitor of planar type such as shown FIG. 1A.

In transponder applications, the capacitance C, C1, C2 is of the described planar type for example. In reader applications, the capacitance C may be in the form of an added capacitor component, instead of being of planar type.

Figure 9B:
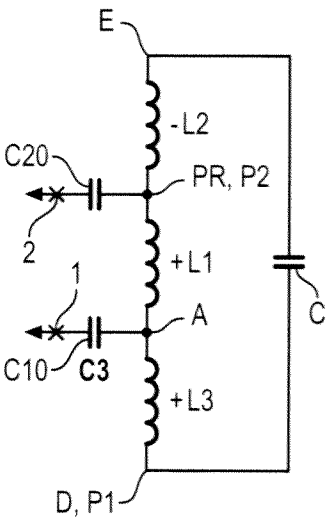
Figure 9A:
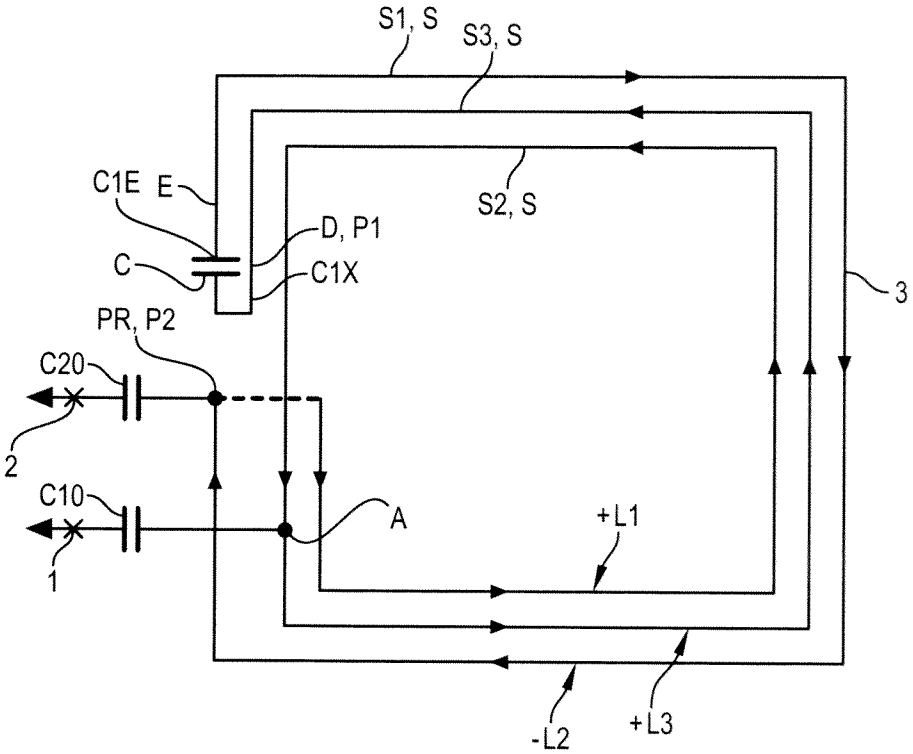

The embodiment shown FIGS. 9A and 9B is a variant of the embodiment shown FIGS. 5A and 5B. In FIGS. 9A and 9B, the antenna 3 is formed from the second end terminal E to the first end terminal D by a first turn S1, a second turn S2, and a third turn S3 which are consecutive. Turn S1 extends from the second end terminal E to a reversal point PR in a first direction of winding, which in FIG. 9A is a clockwise direction. Turns S2 then S3 extend from reversal point PR to the first end terminal D in a second direction of winding opposite the first winding direction, and hence in anti-clockwise direction in FIG. 9A. For example outer turn S1 is in reverse direction compared with inner turns S2 and 53.

The first point P1 is formed by terminal D.

The second point P2, forming the second intermediate tap of the antenna connected to the access terminal 2, is located at reversal point PR.

According to the invention, there is at least one turn S between the first point P1 and the second point P2, i.e. turn A2 and turn S3 in the illustrated embodiment.

In the equivalent schematic in FIG. 95, the circuit of FIG. 9A has a first positive inductance L1, called active inductance, formed by the second turn S2 between points A and P2.

On account of the reversal point PR, there appears a second negative inductance −L2, called passive inductance, lying between intermediate tap P2, PR, and terminal E and formed by the first turn S1, considering that the positive direction of the current in the antenna 3 is the direction extending from point PR, P2 to point A, in this example coinciding with the largest number of turns extending in the same direction, as indicated by the arrows drawn on antenna 3. The arrows drawn on the turns S2 and S3 correspond to this positive direction of the current.

Between the intermediate tap A and terminal D, there is a third positive inductance +L3, called passive inductance, formed by the third turn S3.

The sum of the first inductance L1, of the second inductance L2 in absolute value and of the third inductance L3 is equal to the total inductance L of the antenna 3.

The negative inductance –L2 makes it possible to further reduce the mutual inductance generated by the antenna 3.

Figure 11B:
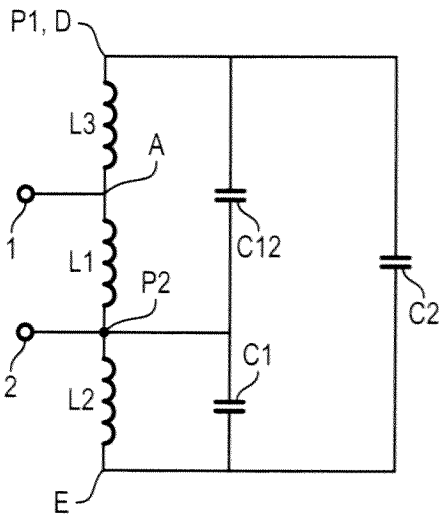
Figure 11A:
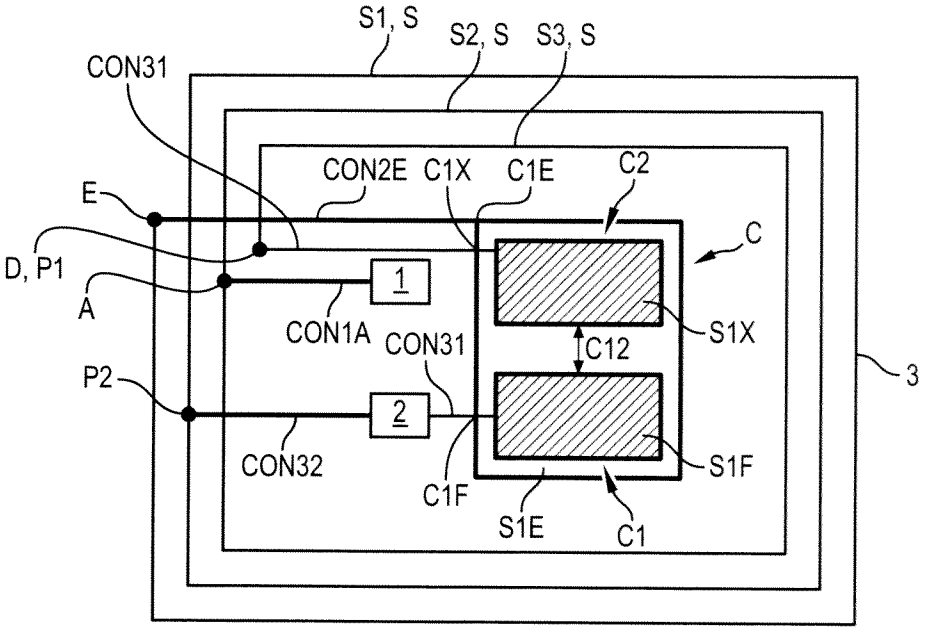

The embodiment shown FIGS. 11A and 11B is a variant of the embodiment illustrated FIGS. 5A and 5B.

The connection means CON1A is an electric conductor for example.

The connection means CON32 is an electric conductor for example.

The capacitance C is of the type shown FIG. 2A.

The second end terminal E of the antenna 3 is connected by a conductor CON2E to the second terminal C1E of the capacitance C.

The first terminal D is connected to the terminal C1F of capacitance C by the conductor CON33.

Point P1 is formed by terminal D.

The first terminal C1X of capacitance C is connected by a conductor CON31 to terminal D.

The terminal C1F is connected to the access terminal 2.

According to the invention, there is at least one turn S between the first point P1 and the second point P2, i.e. turn S3 and turn S2 in the illustrated embodiment.

In the equivalent schematic shown FIG. 11B, the capacitance C1 lies parallel with the inductance L2 between terminal E and point P2. The capacitance C2 is connected between terminals D and E. The coupling capacitance C12 is connected between the second point P2 and the terminal D.

The embodiment illustrated FIGS. 11A and 11B makes it possible to further increase the efficiency of the antenna 3, on account of the coupling between the capacitances C1 and C2.

Evidently, one or more of the above embodiments can be combined regarding the arrangement of the inductances, capacitances, the reversal point (s), the number of turns.

In particular, the connection means such as CON1A, CON32 of the access terminals 1, 2 to the antenna may be via capacitance, via conductor or other, such as active elements for example, in particular of transistor or amplifier type.

Generally, any additional charge or frequency- or power-tuned circuit can be connected to the access terminals 1, 2 such as a chip for example, notably silicon-based, both for the so-called transponder application and the so-called reader application.

In particular, the connection means of the access terminals 1, 2 to the antenna in FIGS. 5A, 6A, 7A, 8A, 9A can also be conductors. It is also possible to add an active or passive element such as a capacitance for example to the access terminals 1, 2 in FIGS. 1A, 2A, 3A, 4A.

Provision may be made for the number of turns to be one, two, or more between the first point P1 and the second point P2. The number of turns provided between the first tap A and end D may be one, two or more. The number of turns provided between the first tap A and end E may be one, two, or more. The number of turns between the first point P1 and end D may be one, two, or more. The number of turns between the first point P1 and end E may be one, two, or more. The number of turns between the second point P2 and end D may be one, two, or more. The number of turns provided between the second point P2 and end E may be one, two, or more.

The antenna may be made using wire, etched, printed (printed circuit board) technology, in copper, aluminium, with silver or aluminium particles and any other electric conductor and any other non-electric conductor but chemically provided for this purpose.

The turns of the antenna may be multi-layer, whether superimposed or not, either in whole or in part.

Figure 10:
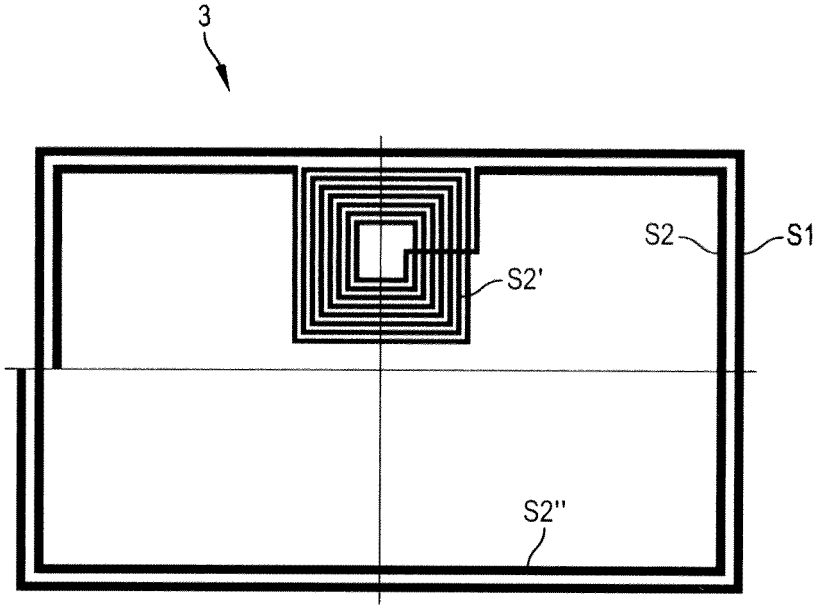
FIG. 10 is a view of an antenna in one embodiment.

As illustrated FIG. 10, at least one turn S2 of the antenna can comprise in series a winding S2' of turns of smaller surface surrounded, with respect to the surface surrounded either by the remainder S2" of turn S2 or by the other turns of the antenna 3, in order to increase the resistance or inductance of turn S2 without enhancing coupling, mutual inductance, and the general radiation of the antenna 3.

The capacitance(s) may be a discrete element (component) or fabricated using planar technology.

The capacitance(s) can be added to the antenna during fabrication of the coil windings, as an external element to the printed circuit board and antenna, notably using wire technology.

The capacitance(s) may be integrated into a module, notably the silicon module.

The capacitance(s) can be integrated in and fabricated on a printed circuit board.

The turns S of the antenna 3 may be distributed over several separate physical planes, e.g. parallel.

The turns are formed of sections e.g. rectilinear but may also be of any other shape.

The turns of the antenna may be in the form of a wire, which is then heated to be incorporated on or in an insulator substrate.

The turns of the antenna may be etched onto an insulator substrate.

The turns of the antenna can lie on opposite faces of an insulator substrate.

The turns are in the form of parallel strips for example.

In the following figures, a charge module M is shown, such as a chip for example, the module M being connected between the first access terminal 1 and the second access terminal 2.

Figure 12:
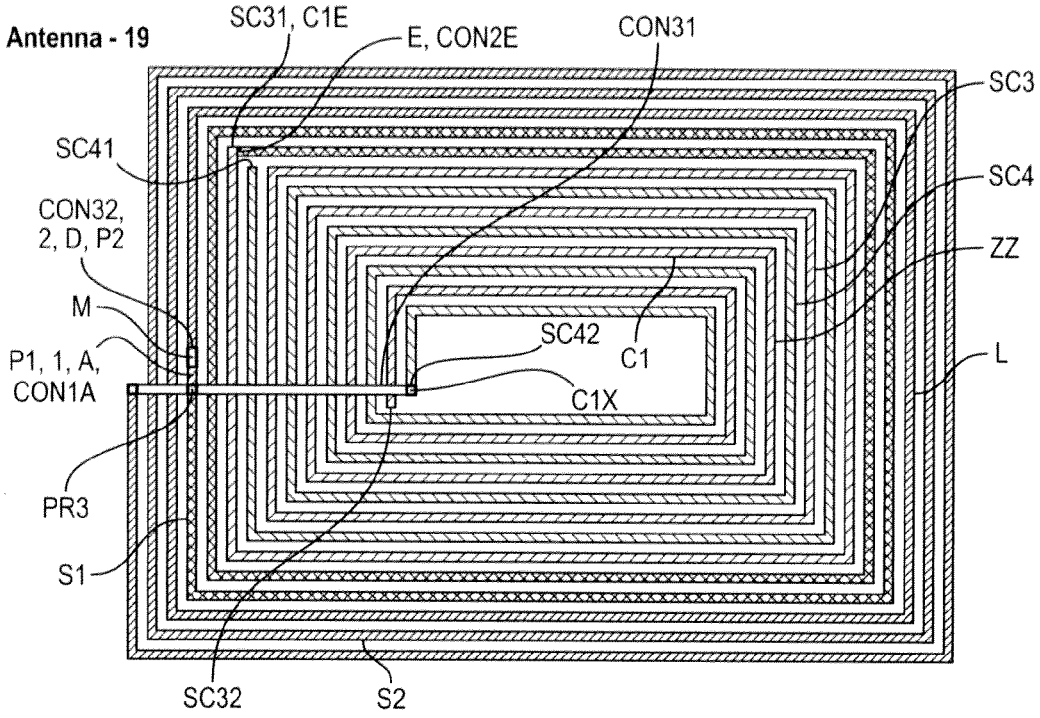
FIGS. 12 to 46 show embodiments of the circuit according to the invention.
Figure 13:
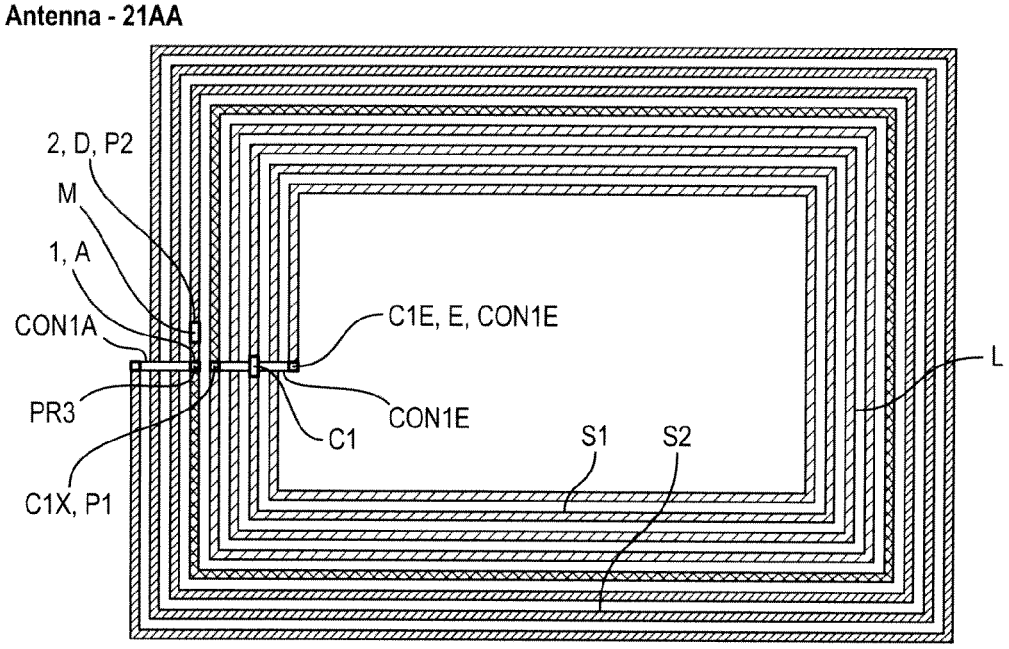
Figure 14:
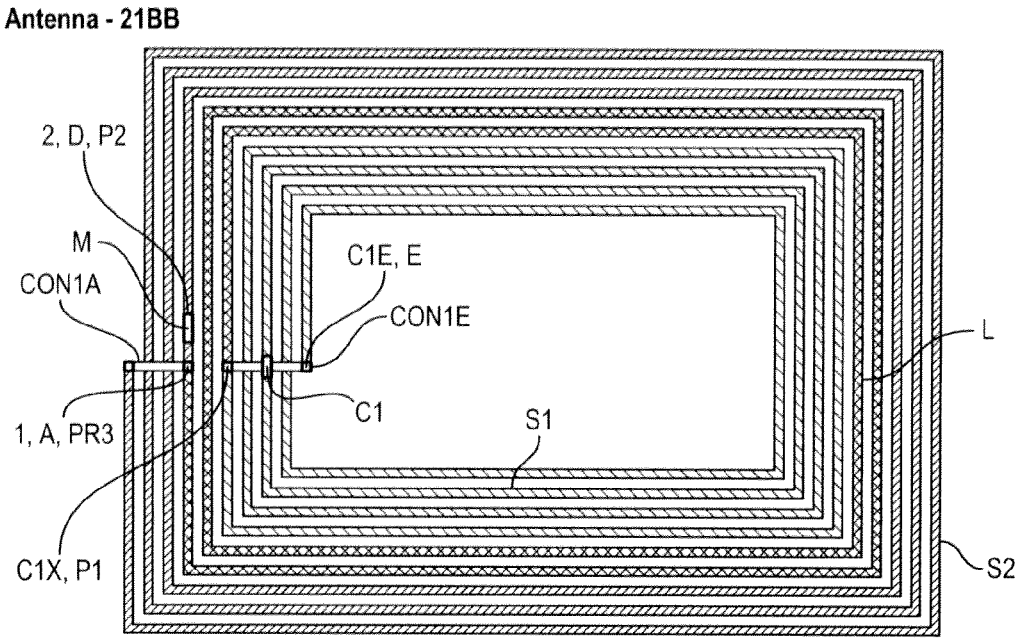
Figure 15:
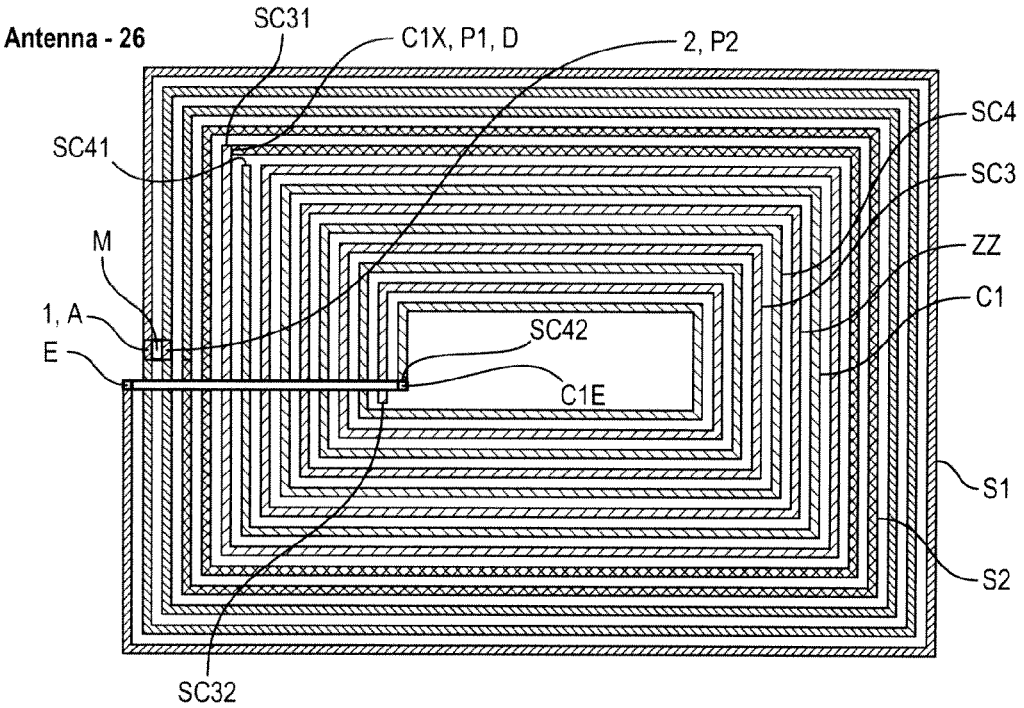

In the embodiment shown FIG. 12, the antenna L is formed by the turns S1, S2 located between the first end terminal S and the second end terminal E.

The first terminal D is connected to the second access terminal 2 forming the second point P2.

The tuning capacitance C1 with a prescribed tuning frequency comprises a first capacitance terminal C1X and a second capacitance terminal C1E.

The first capacitance terminal C1X is connected to the first access terminal 1 by means CON31.

The second capacitance terminal C1E is connected to the second end terminal E.

The second point P2 is formed by the second access terminal 2.

The first point P1 of the antenna and the intermediate tap A of the antenna are formed by the first access terminal 1.

The second point P2, 2 of the antenna L is connected to the first point P1, 1, A of antenna L by at least one first turn S1 of the antenna L.

The antenna L is formed by one or more second turns S1 between E and A, namely by two second turns S1 for example connected by point A to one or more turns S2 extending from point A to terminal D, for example three turns S2.

There is a least one turn of the antenna L between the first point P1 and the second point P2, namely the at least one turn S2 between P1 and P2.

The tuning capacitance C1 is formed by one or more third turns SC3 (for example five turns SC3) comprising two first and second ends SC31, SC32, and by one or more fourth turns SC4 (for example five turns SC4) comprising two first and second ends SC41 SC42.

The at least one third turn SC3 is separate from turns S1, S2 forming the antenna L, and is connected to one E of the end terminals of the antenna L. The at least one fourth turn SC4 is separate from turns S1, S2 forming the antenna L and is separated electrically from the third turns SC3, for example by running alongside the third turns SC3 so that the turns SC3 are arranged facing turns SC4, for example having parallel sections. End SC31 forms terminal C1E and is connected to terminal E. End SC32 is free and insulated from SC4. End SC41 is free and insulated from SC3. End SC42 forms terminal C1X and is connected to the intermediate tap A, 1, P1. End SC31 lies distant from end SC42 whilst lying close and being insulated from end SC41. End SC42 lies distant from end SC31, whilst lying close to and being insulated from end SC32.

Figure 33:
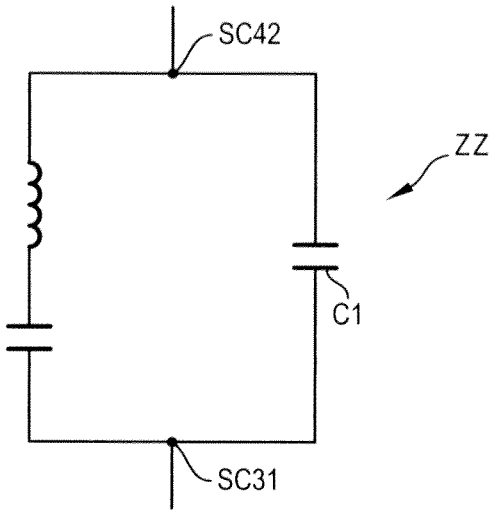

The sections of the third turns SC3 located facing fourth turns SC4, which are not electrically connected to the fourth turns SC4, define the capacitance C1. On account of the third turns SC3 and fourth turns SC4 themselves causing inductance due to winding of the turns, the impedance ZZ between the ends SC31, SC42 serving to connect the capacitance C1 to the remainder of the circuit, also brings an inductance. The impedance ZZ between the connecting ends SC31, SC42 can be seen for example as comprising a resonant capacitance—inductance circuit in parallel and/or series in accordance with FIG. 33, comprising two parallel branches with capacitance C1 in one of the branches and a capacitance in series with an inductance in the other branch. As a result, the impedance ZZ seen between the connecting ends SC31, SC42 comprises the capacitance C1.

The capacitance value C1 of impedance ZZ depends on the relationship between the turns SC3 and SC4, and in particular on their reciprocal arrangement, for example lying adjacent.

In FIG. 12, there is at least one turn S1 between the intermediate tap A connected to the access terminal 1 of the module and the impedance ZZ formed by the at least one third turn SC3 and the at least one fourth turn SC4.

The impedance ZZ formed by the at least one third turn SC3 and by the at least one fourth turn SC4 is self-resonating, due to the fact that a capacitance and an inductance in series and/or parallel are contained in the impedance ZZ.

Figure 34:
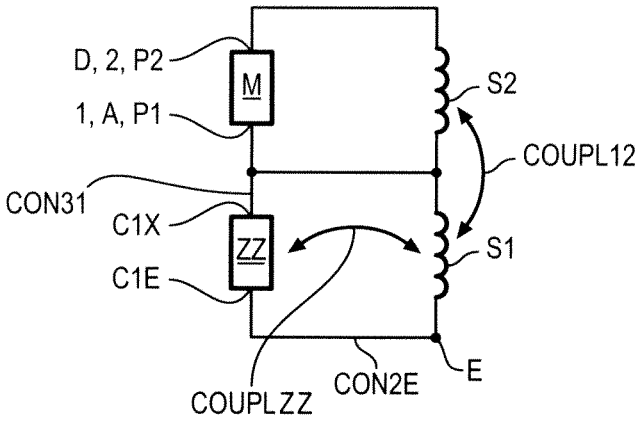

The equivalent schematic of the circuit illustrated FIG. 12 is given in FIG. 34. The at least one third turn SC3 and the at least one fourth turn SC4 make it possible to equalize the tuning frequency of module M (a chip for example) lying parallel with an inductance (turn(s) S2) with the tuning frequency of the circuit formed by the at least one third turn SC3 and the at least one fourth turn SC4, for example to have the prescribed tuning frequency 13.56 MHz.

In this way, it is possible to obtain extensive coupling between the self-resonating circuit ZZ, SC3, SC4 and the circuit formed by module M lying parallel with the turn(s) S2, by reducing the mutual inductance between these two circuits. The inductance formed by the turn(s) S1 located between module M and turns SC3, SC4 forming the self-resonating circuit ZZ makes it possible to act on this mutual inductance between the self-resonating circuit ZZ, SC3, SC4 and the circuit formed by module M lying parallel with turn(s) S2.

Therefore, through an astute arrangement of the values of currents and intrinsic inductances of the turns, it becomes possible to parameterize the mutual inductance values between the two above-mentioned antenna circuits (M, S2) and (ZZ, S1) and to obtain two frequency tunings that are quasi-independent of each other or two tuning frequencies very close to each other, for example with differences in tuning frequencies of <10 MHz, <2 MHz or <500 KHz, or 2 frequency tunings merged in one same frequency range, making it possible to obtain a broad bandwidth relative to the RFID transmission channel, whilst maintaining extensive coupling efficiency and hence energy transmission, even though the integration surface of the antenna circuit may be very small e.g. <16 $cm^2$ or <8 $cm^2$.

It is notably sought to have the greatest possible inductance in the turns S2 lying parallel with the module M, in order to obtain a frequency tuning that is as close as possible to the useful frequency, for example 13.56 MHz.

It is sought in particular to have the smallest possible inductance contained in the self-resonating circuit ZZ, SC3, SC4 to allow integration of the antenna circuit on a small surface <16 $cm^2$ such as a tag for example or a sticker.

In addition, it can be seen that one of the advantages of the invention is the possibility to parameterize the mutual inductance between the antenna circuits, for example between, firstly, the antenna circuit comprising the transponder or reader chip and, secondly, a first and a second antenna part, so as to parameterize the final mutual inductance of the transponder or reader system. Also, contrary to the prior art documents indicated above, it becomes possible to produce two frequency tunings quasi-independent of each other, or two frequency tunings very close to each other for example <10 MHz, <2 MHz or <500 KHz or 2 frequency tunings merged over one same frequency range.

Depending on the embodiment of the invention, there is at least one electric connection between a first antenna circuit comprising the chip and at least one second (or more) antenna circuit(s) comprising at least one capacitive element.

In particular, the devices according to documents EP-A-1,031,939 and FR-A-2,777,141 do not allow two quasi-independent frequency tunings to be produced, or two frequency tunings very close to each other e.g. <10 MHz, <2 MHz or <500 KHz, or 2 frequency tunings merged over one same frequency range. The greater the mutual inductance between the 2 antenna circuits, the greater the increase in the 2 so-called "natural" tunings of the 2 antenna circuits. If it is desired that these 2 frequency tunings should be close, mutual inductance must be reduced, for example by strongly decreasing one of the surfaces of the antenna circuit relative to the other, which induces a considerable loss in the efficiency of the transponder.

Means are provided to ensure coupling COUPL12 by mutual inductance between the neighbouring turns S1 and S2. Means are provided to ensure coupling COUPLZZ by mutual inductance between the neighbouring turns S1 and SC3, and SC4 of impedance ZZ. This coupling by mutual inductance is due for example to the arrangement of S1 close to S2 and to the arrangement of S1 close to SC3, SC4. For example in FIG. 12 we successively have from the periphery towards the centre: S2, S1, SC3, SC4.

The antenna circuit has at least two natural intrinsic mutual inductances coupled together: between S1 and S2, between S1 and ZZ.

This makes it possible to increase the reading distance of the circuit in FIG. 12.

Other embodiments of the invention are described in the table below with reference to the figures mentioned below. This table indicates the points electrically connected together in the four corresponding columns (1, A), (C1E, E), (C1X, P1), and (2, P2) and the number of turns. In FIG. 12 et seq mentioned below, the connection means CON1A of the intermediate tap A with the first access terminal 1, the connection means CON2E between the second end terminal E and the second capacitance terminal C1E, the connection means CON31 between the first capacitance terminal C1X and the first point P1 of the antenna L, and connection means CON32 between the second access terminal 2 and the second point P2 are implemented via electric conductors, these not necessarily being indicated either in the figures or in the table below. Column A-E indicates the number of turns S1 between A and E. Column A-D indicates the number of turns S2 between A and D. Column P1-P2 indicates the number N12 equal to at least one turn S of the antenna L between points P1 and P2. The last column on the right indicates either the presence of the impedance ZZ formed by the turns SC3 and SC4, in this case giving the number of turns of ZZ in brackets, or the presence of an additional capacitance C30 called first capacitance formed by a capacitive component with a dielectric between its terminals.

By dielectric capacitive component is meant any embodiment allowing the arrangement of a capacitance. This capacitive component may optionally be formed by another circuit ZZ.

| FIG. N° | 1, A | C1E, E | C1X, P1 | 2, P2 | A-E | A-D | P1-P2 | Z and/or C1 |
|---|---|---|---|---|---|---|---|---|
| 1A | P1, C1X | C1E, E | 1, A | D | ≥1 | ≥1 | ≥1 | C1 |
| 2A | P1, C1X | C1E, E | 1, A | D, C1F | ≥1 | ≥1 | ≥1 | C1 |
| 3A | C1F | C1E, E | C1X, P1 | D | ≥1 | ≥1 | ≥1 | C1 |
| 4A | P1, C1X, PR | C1E, E | 1, A, PR | D | ≥1 | ≥1 | ≥1 | C1 |
| 5A | 1, A | C1E, E | D | 2, P2 | ≥1 | ≥1 | ≥1 | C1 |
| 6A | 1, A | C1E, E | D | 2, P2 | ≥1 | ≥1 | ≥1 | C1 |
| 7A | 1, A | C1E, E | D | 2, P2 | ≥1 | ≥1 | ≥1 | C1 |
| 8A | 1, A | C1E, E | D | 2, P2 | ≥1 | ≥1 | ≥1 | C1 |
| 9A | 1, A | C1E, E | D | 2, P2, PR | ≥1 | ≥1 | ≥1 | C1 |
| 11A | P1 | C1E, E | 1, A | 2, P2, C1F | ≥1 | ≥1 | ≥1 | C1 |
| 12 | P1, C1X, SC42 | SC31 | 1, A, SC42 | D | 2 | 3 | 3 | Z(5) |
| 13 | 1, A | C1E, E | P1≠A | D | 5 | 3 | 4 | C1 |
| 14 | 1, A | C1E, E | P1≠A | D | 6 | 3 | 5 | C1 |
| 15 | 1, A | SC42 | D | 2, P2 | 1 | 4 | 3 | Z(4) |
| 16 | 1, A | SC42 | D, C1XZ | 2, P2 | 1 | 4 | 3 | Z and C30 |
| 17 | 1, A | SC42 | D | 2, P2 | 1 | 2 | 1 | Z(4) |
| 18 | 1, A | SC42 | D, C1XZ | 2, P2 | 1 | 2 | 1 | Z(4) and C30 |
| 19 | 1, A | SC42 | D, SC31 | E | 3 | 2 | 5 | Z(4) |
| 20 | C1X, P1 SC42 | C1E, E (with D = SC41) | 1, A, SC42 | PC1 | 3 | 4 | 3 | Z(5) and C30 |
| 21 | C1X, SC31, P1 | 2, P2, SC42 | SC31, 1, A | E (with D = SC32) | 3 | 4 | 3 | Z(4) |
| 22 | C1X, P1, SC42 | C1E, E (with D = SC41) | 1, A, SC42 | PC1, SC31 | 3 | 4 | 3 | Z(4) and C30 |
| 23 | 1, A | C1E, E | D | 2, P2 | 4 | 1 | 4 | C1 |
| 24 | 1, A | C1E, E | D | PR2 | 4 | 1 | 3 | C1 |
| 25 | C1X, P1, PR1 | C1E, E | 1, A | D | 4 | 1 | 1 | C1 |
| 26 | C1X, P1, PR1 | C1E, E | 1, A | D | 3 | 2 | 2 | C1 |
| 27 | C1X, P1 | C1E, E | 1, A | D | 2 | 3 | 3 | C1 |
| 28 | 1, A | C1E, E | C1X, P1≠A | D | 2 | 2 | 1 | C1 |
| 29 | 1, A | C1E, E | D | 2, P2 | 5 | 1 | 5 | C1 |
| 30 | 1, A | C1E, E | D | 2, P2 | 2 | 1 | 2 | C1 |
| 31 | C1X, P1, SC42 | C1E, E, SC31 | 1, A, SC42 | D | 2.5 | 4 | 4 | Z(17) |
| 32 | C1X, P1, SC42 | C1E, E, SC31 | 1, A, SC42 | D | 5.5 | 3 | 4 | Z(17) |

Figure 16:
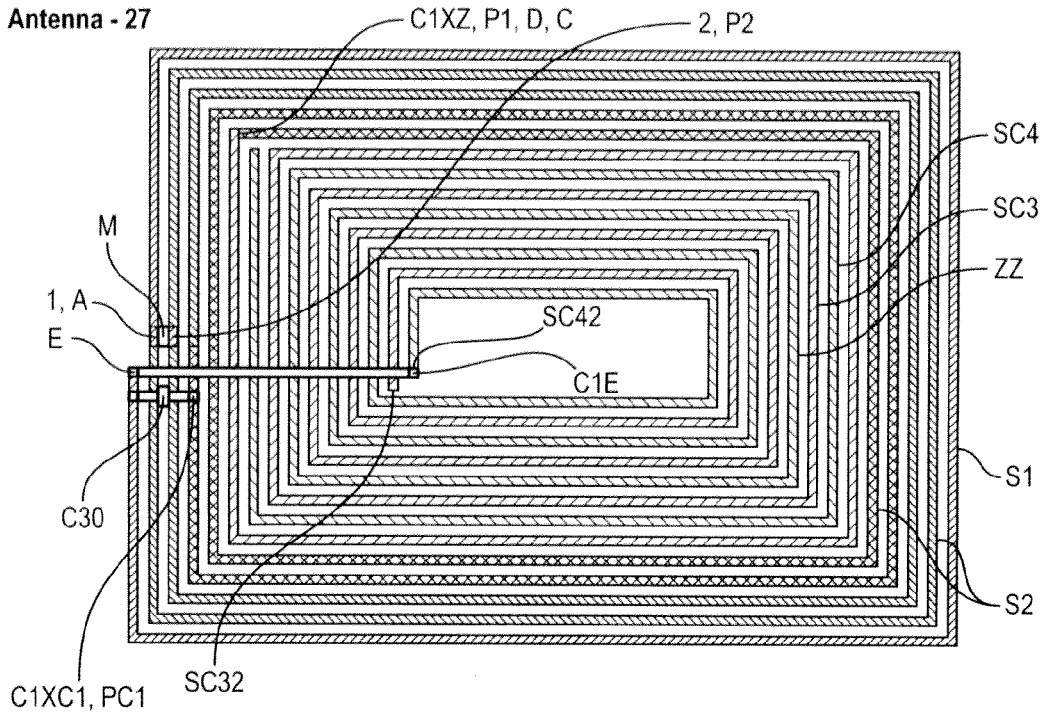
Figure 17:
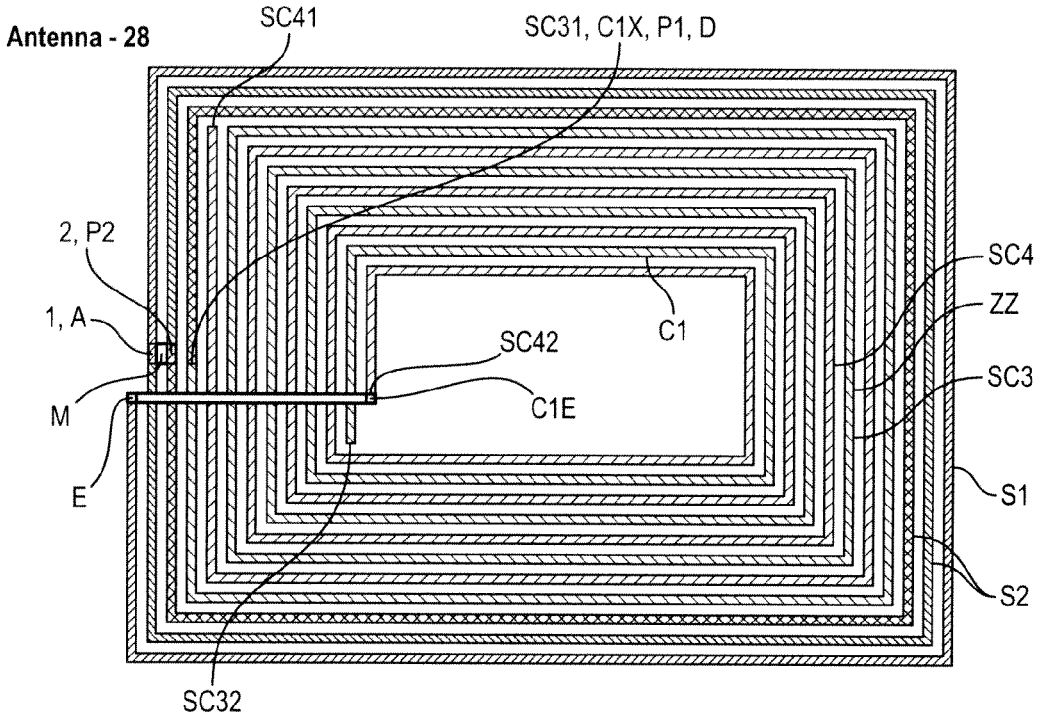
Figure 18:
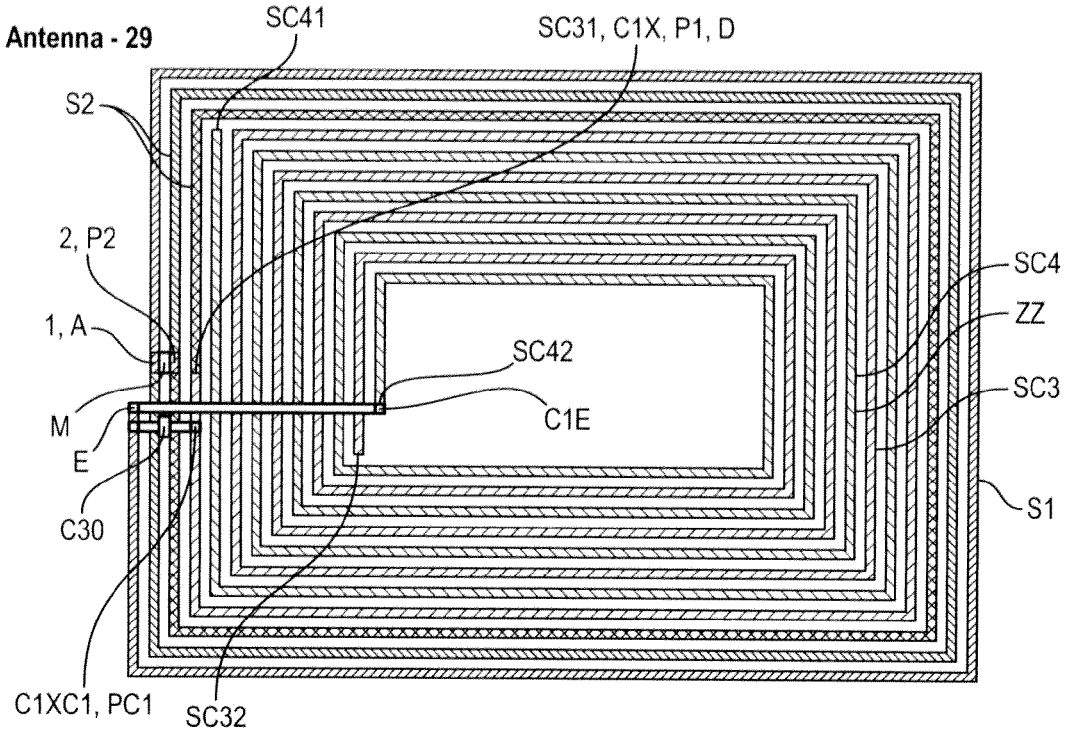
Figure 19:
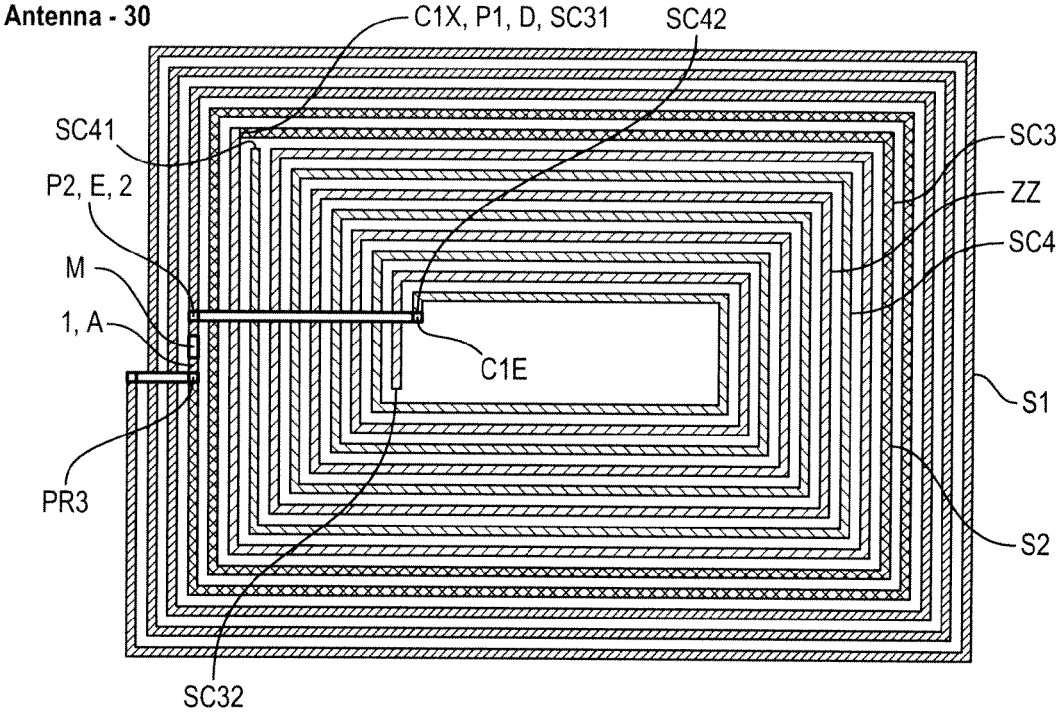

In FIGS. 16 and 18, two capacitances C30 and ZZ are provided. Capacitance ZZ is formed by turns SC3, SC4 between SC42 and SC31 (4 turns for example) with SC31 forming C1XZ. In addition to Z, another capacitance C30 formed by a capacitive component is provided between E and C1XC1. The terminal C1XC1 is connected to a point PC1 of the antenna L, which lies distant from P2 by at least one turn, for example one turn in this figure. In FIGS. 16 and 18, ZZ lies between C1XZ and C1E, and C30 is a capacitive component between E and C1XC1.

Figure 22:
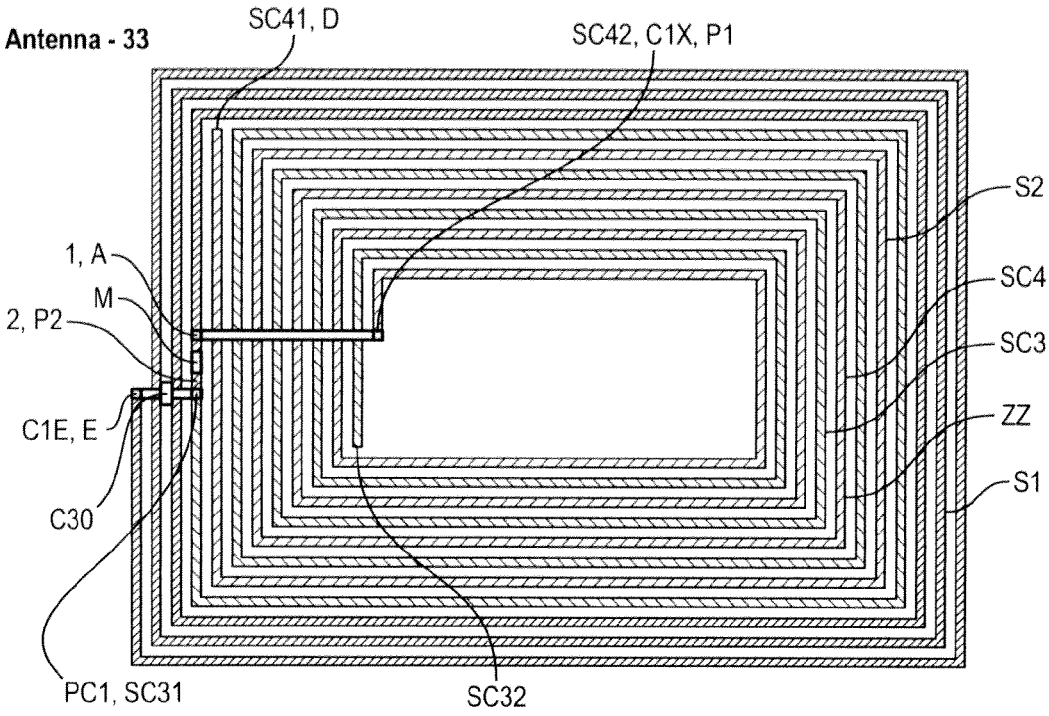

In FIG. 22, two capacitances C30 and ZZ are provided in series between the terminal C1E, E and the terminal C1X, P1 formed by end SC42. The capacitance ZZ is formed by turns SC3, SC4 between SC42 and SC31 (for example 4 turns) with SC31 forming PC1. In addition to Z, another capacitance C30 formed by a capacitive component is provided between E and PC1. Terminal PC1 is connected to point 2, P2 of the antenna L. Terminal C1E, E is formed by the end of the turn or turns S1, distant from terminal 2.

Figure 20:
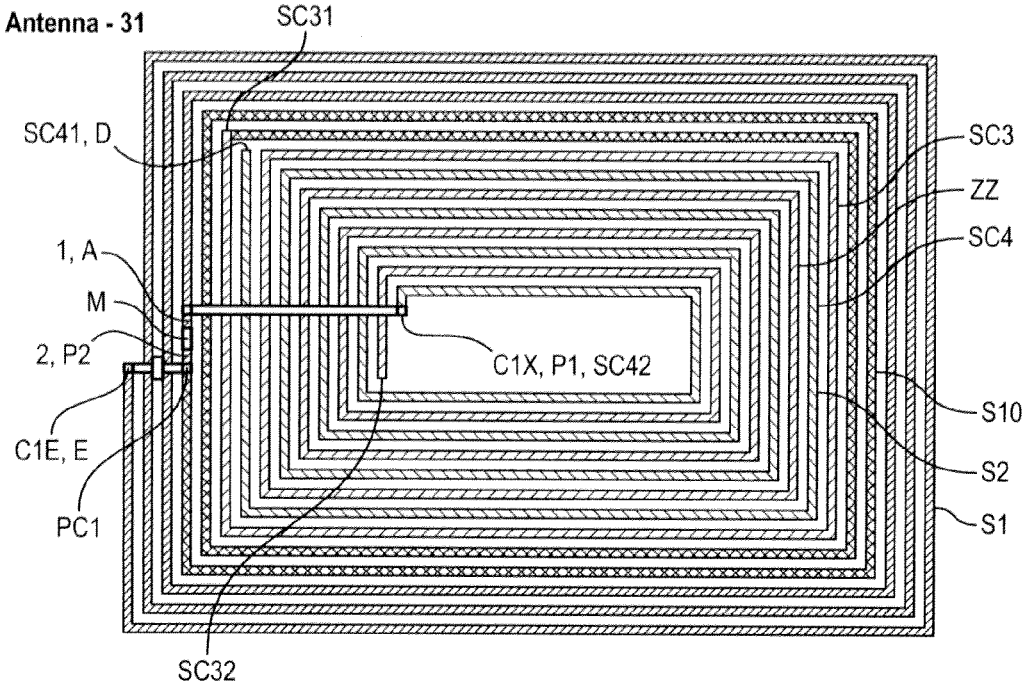
Figure 21:
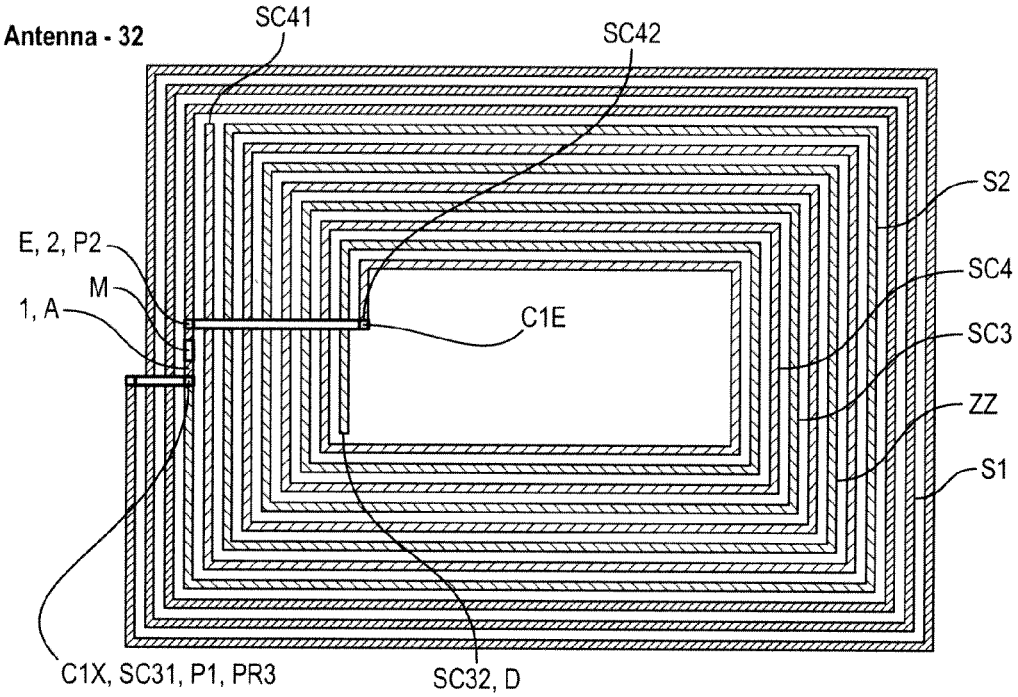

In FIG. 20, two capacitances C30 and ZZ are provided in series between the terminal C1E, E and the terminal C1X, P1 formed by end SC42. The capacitance ZZ is formed by the turns SC3, SC4 between SC42 and SC31 (4 turns for example) with SC31 connected in series with point PC1 by one or more turns S10 (for example two turns S10). In addition to Z, another capacitance C30 formed by a capacitive component is provided between E and PC1. Terminal PC1 is connected to point 2, P2 of the antenna L. Terminal C1E, E is formed by the end of the turn or turns S1 lying distant from terminal 2.

Figure 23:
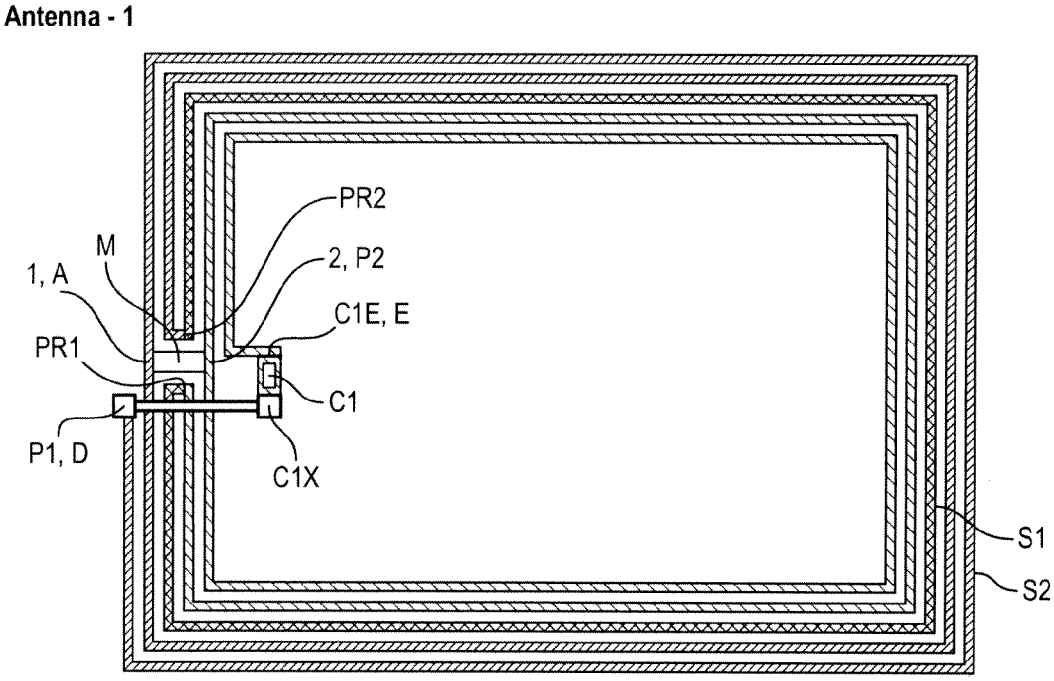
Figure 24:
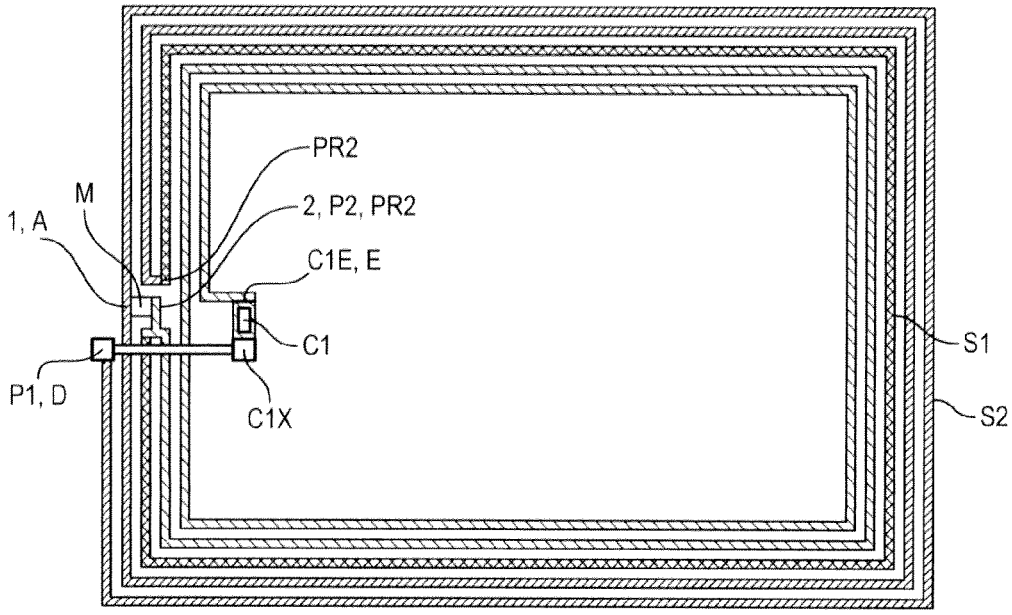

In FIGS. 23, 24 two reversal points PR1 and PR2 are provided in the turns S1 between A and E. Point PR1 lies distant from A by at least one turn and from E by at least one turn (for example two turns between A and PR1 and two turns between PR1 and E). Point PR2 lies distant from A by at least one turn and from E by at least one turn (for example one turn between A and PR2 and three turns between PR2 and E).

In FIG. 23, PR2 lies distant from P2 by at least one turn.

Figure 25:
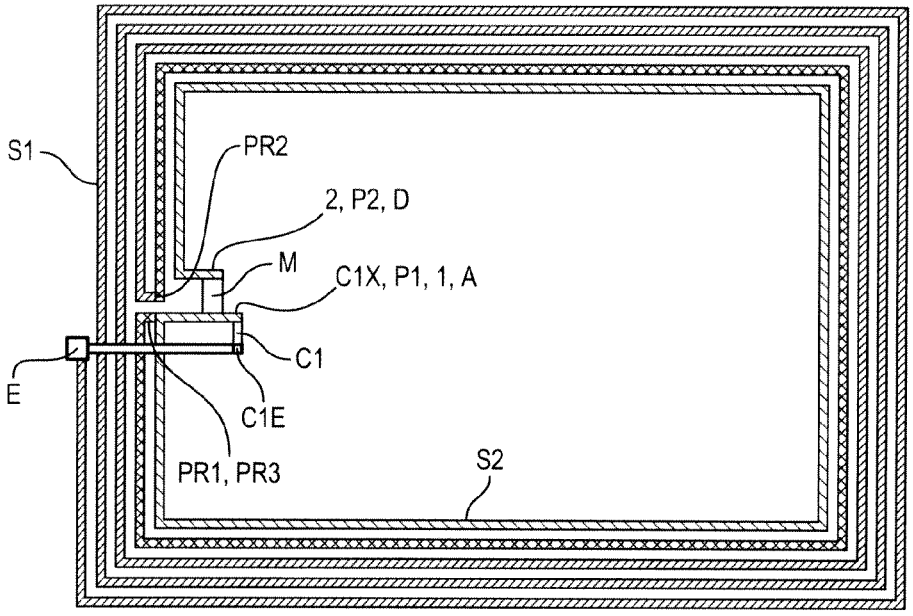

In FIG. 25, two reversal points PR1 and PR2 are provided in the turns S1 between A and E. Point PR1 is located at A. Point PR2 lies distant from A by at least one turn and from E by at least one turn (for example one turn between A and PR2 and three turns between PR2 and E).

Figure 26:
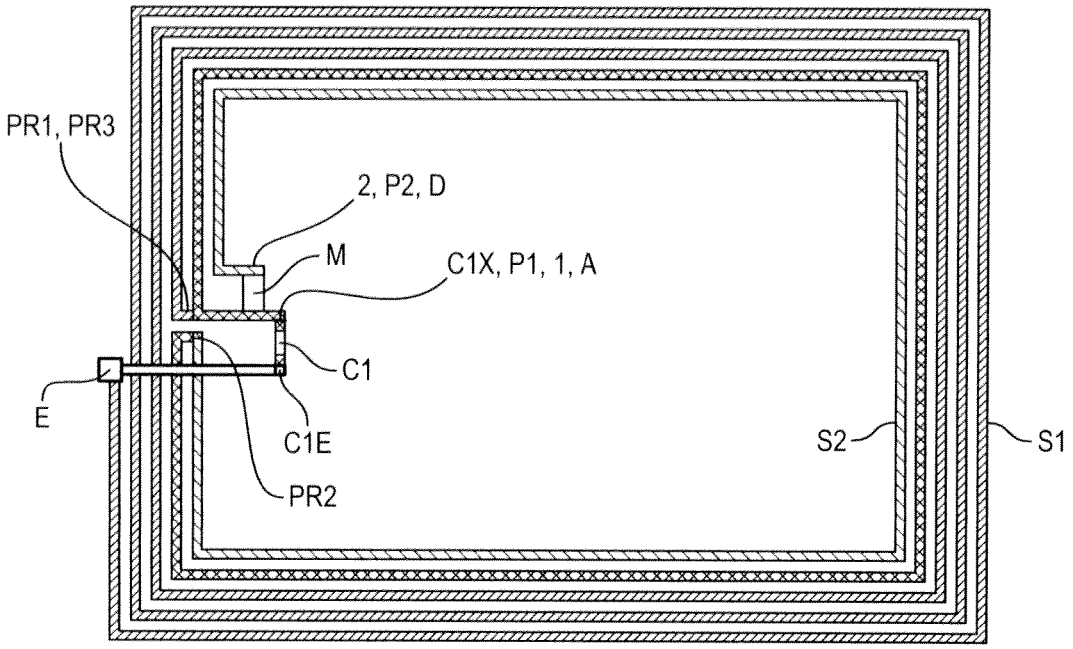

In FIG. 26, two reversal points PR1 and PR2 are provided in the turns S1 between A and E. Point PR1 is located at A. PR2 lies distant from A by at least one turn and from E by at least one turn (for example one turn between A and PR2 and four turns between PR2 and 5).

Figure 27:
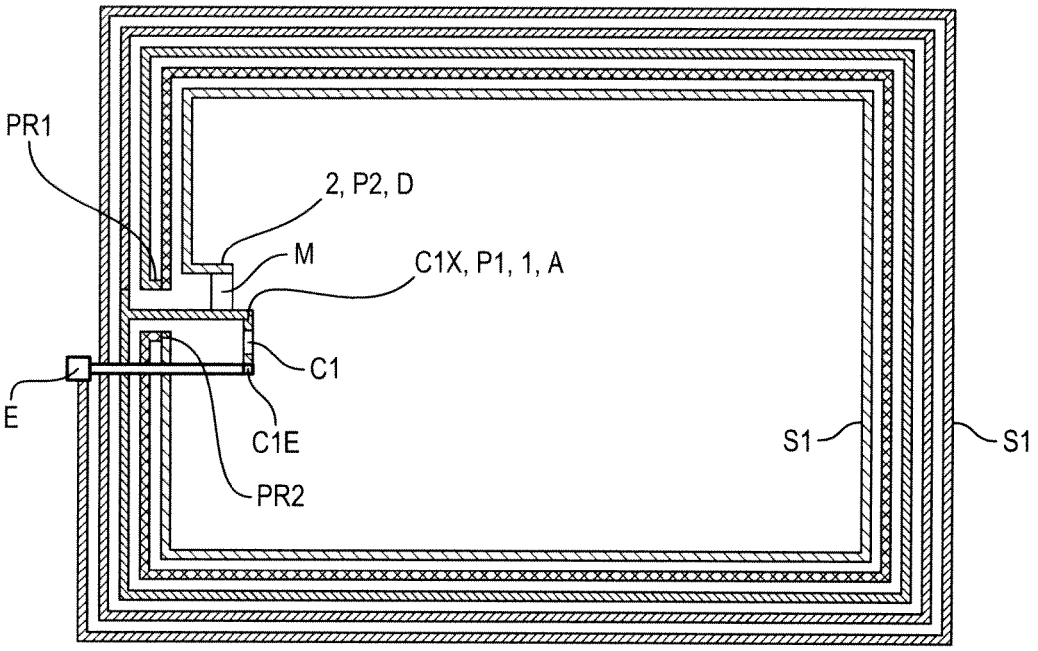
Figure 28:
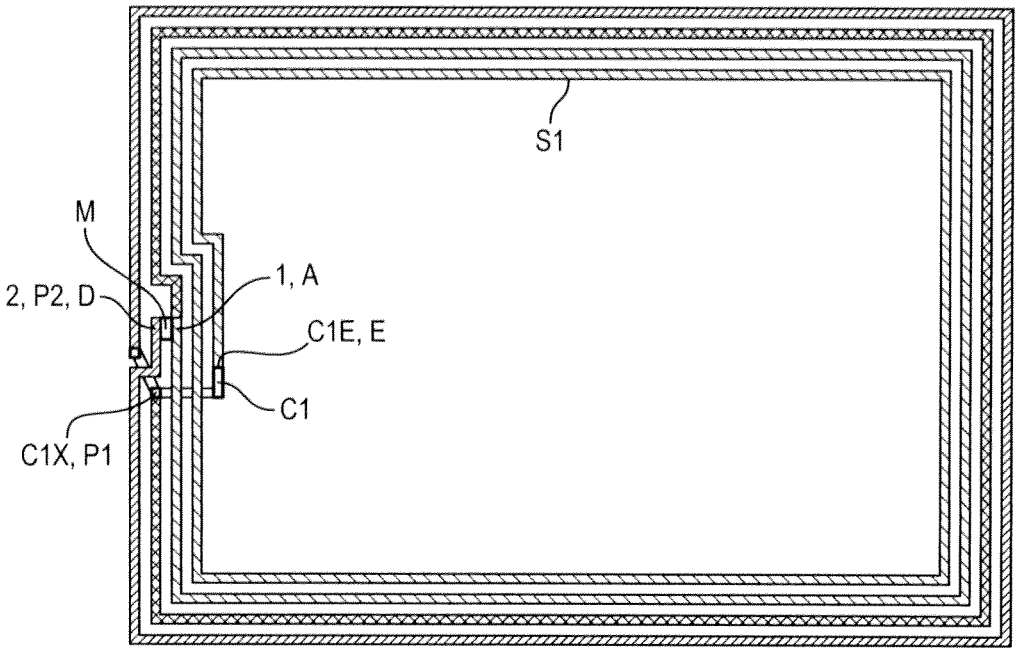

In FIG. 27, two reversal points PR1 and PR2 are provided in the turns S1 between A and D. Point PR1 lies distant from A by at least one turn and from D by at least one turn (for example one turn between A and PR1 and two turns between PR1 and D). Point PR2 lies distant from A by at least one turn and from D by at least one turn (for example two turns between A and PR2 and one turn between PR2 and D).

Figure 29:
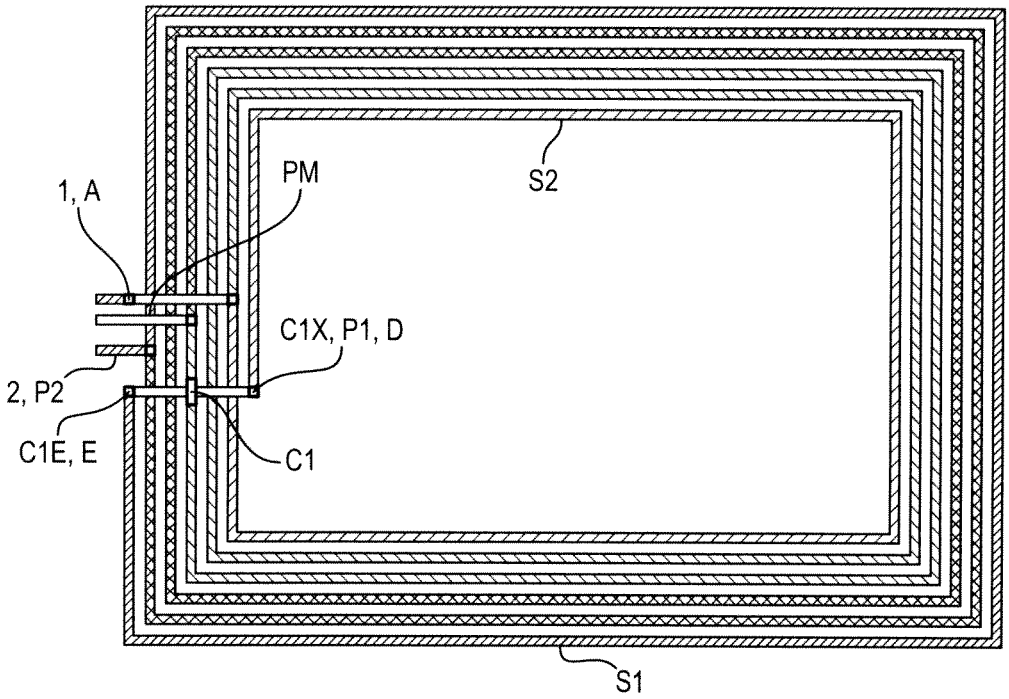
Figure 30:
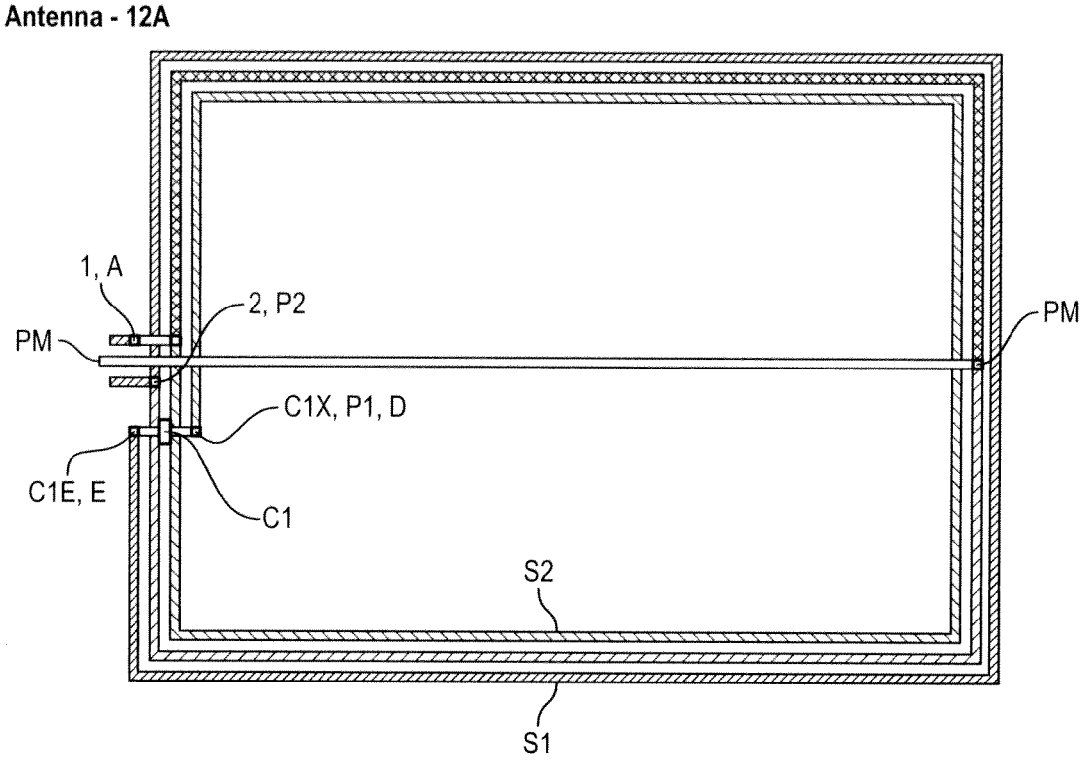

In FIGS. 29 and 30, a mid-point PM to set a potential at a reference potential is provided on the antenna midway between the two end terminals D and E of the antenna. In FIG. 29, in which the number of turns of the antenna between D and E is an even number, the mid-point PM lies distant from the other points 1, A, 2, P2, C1E, E, C1X, P1, D by at least one turn of the antenna. In FIG. 30 in which the number of turns of the antenna between D and E is an uneven number, the mid-point PM lies distant from the other points 1, A, 2, P2, C1E, E, C1X, P1, D by at least one half-turn of the antenna and lies, for example, on the other side relative to the side having these points 1, A, 2, P2, C1E, E, C1X, P1, D.

Figure 31:
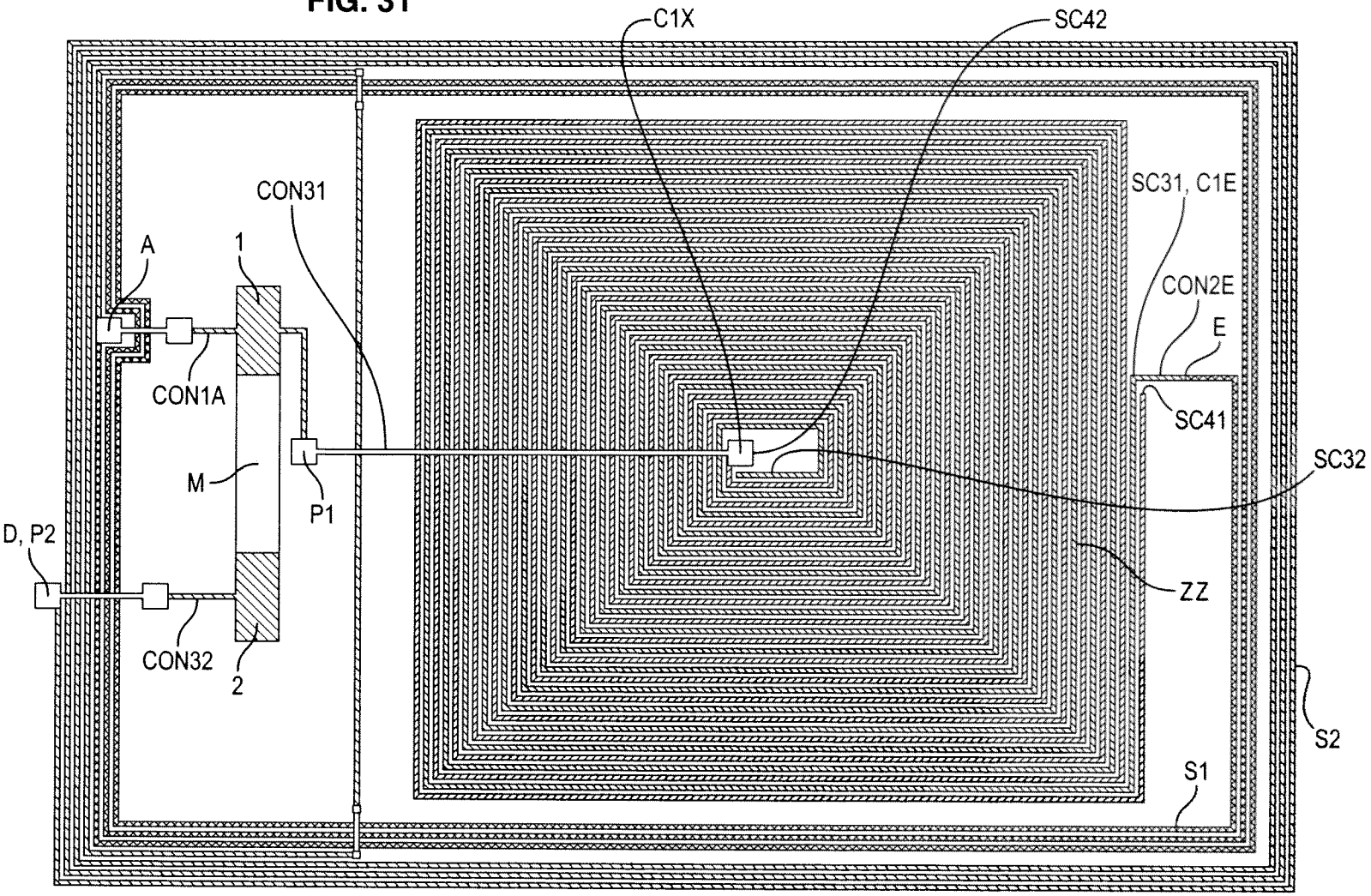
Figure 32:
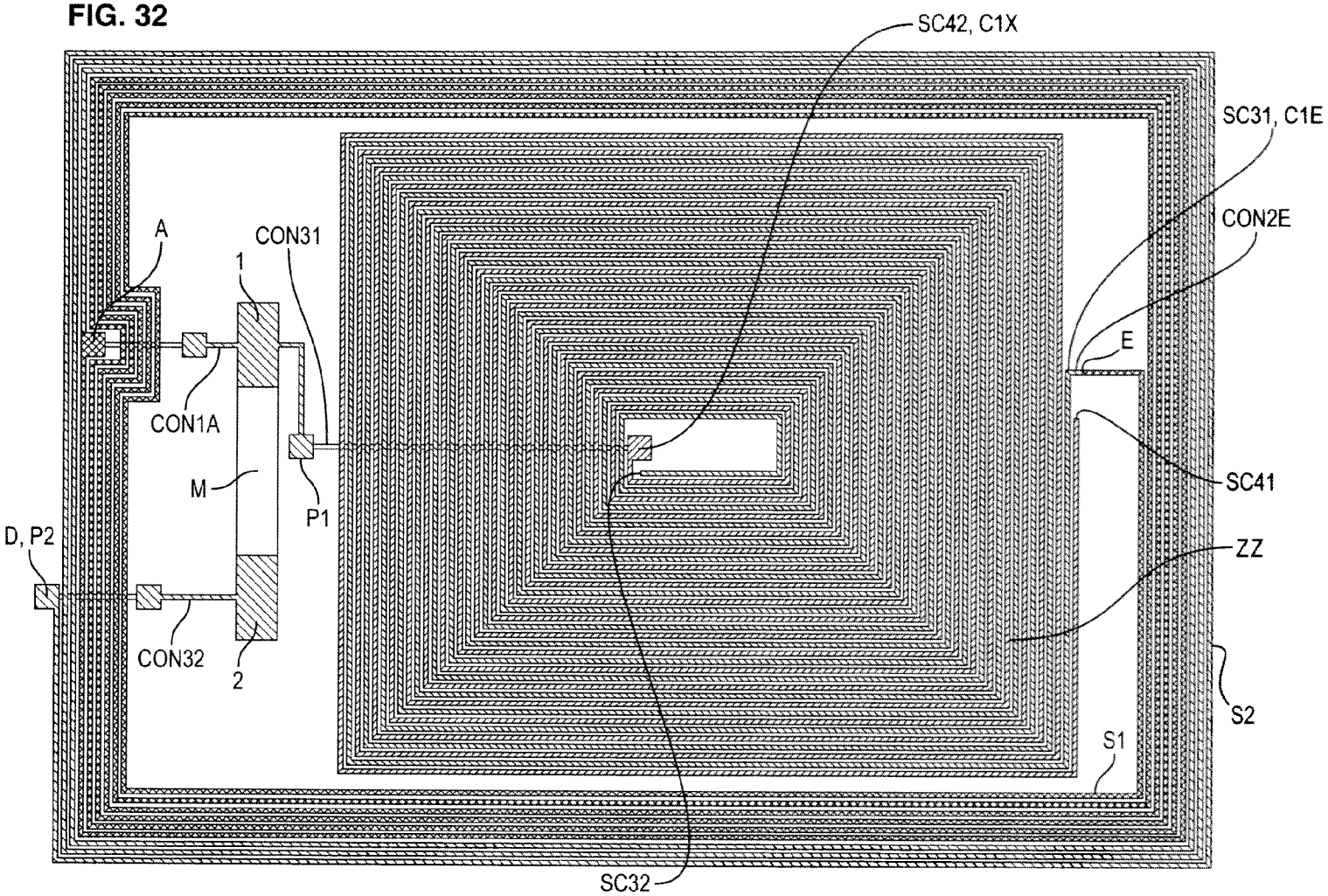

Evidently, in the foregoing, the number of turns between the above-mentioned points on the antenna (1, A, 2, P2, C1E, E, C1X, P1, D and the reversal point or points) may be any number, for example one or more. This number of turns may be an integer for example as shown in the figures, or non-integers such as in FIGS. 31 and 32.

In FIGS. 12, 13, 14, 19, 21, 25, 26, a reversal point PR3 is provided at point 1, A i.e. a reversed direction of winding of the turns of the antenna at point 1, A, when going from D towards E. In FIGS. 15, 16, 17, 18, 22, 23, 24, 27, 28, 29, 30, 31, and 32, point 1, A is passed in the direction from D towards E maintaining the same winding direction of the antenna turns. However, one or more changes in direction of winding of the turns is made at a point PR2, PR1 other than 1, A in FIGS. 23, 24, 26, 27.

The first access terminal is distinct from the second access terminal. The first access terminal is distant from the second access terminal by one or several turns.

One single first access terminal 1 and one single second access terminal 2 are for example provided.

Figure 35:
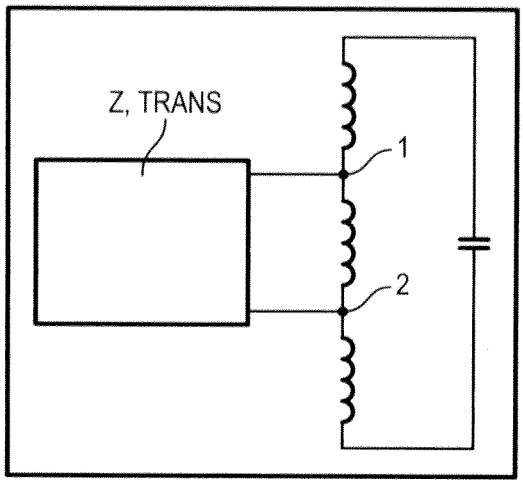

In an embodiment, a transponder TRANS as charge Z is connected to the first access terminal 1 and to the second access terminal 2, as for example on FIG. 35.

The FIGS. 35 to 46 correspond to any one of the embodiments described above, in which the capacitances C10, C20 which may be present were not shown.

Figure 36:
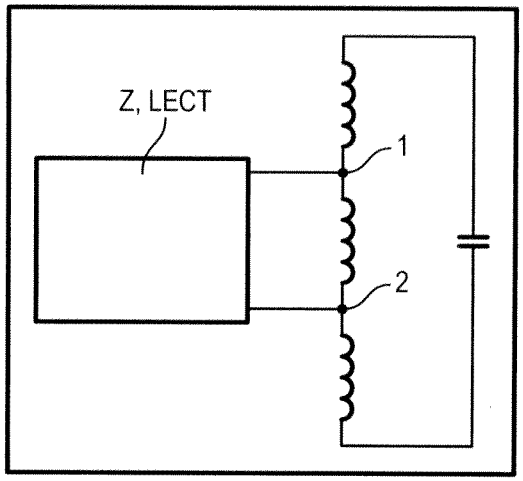

In another embodiment, a reader LECT as charge Z is connected to the first access terminal 1 and to the second access terminal 2, as for example on FIG. 36.

Several charges may be provided.

In another embodiment, several distinct charges may be connected to the same first access terminal 1 and to the same second access terminal 2.

Figure 37:
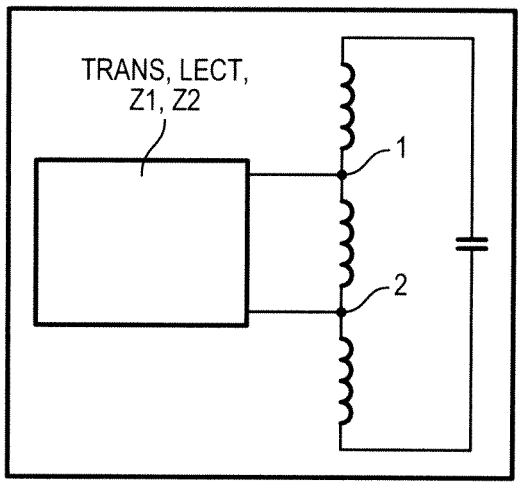
Figure 38:
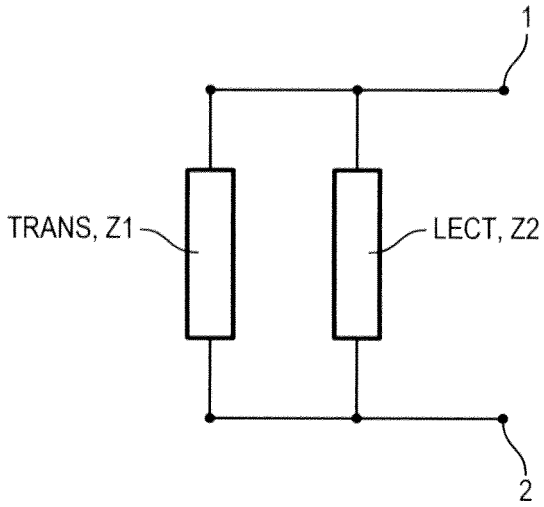

For example, a transponder TRANS as first charge Z1 and a reader LECT as second charge Z2 may be connected to the same first access terminal 1 and to the same second access terminal 2, as shown for example on FIGS. 37 and 38, wherein the transponder TRANS and the reader LECT are electrically in parallel on FIG. 38.

In another embodiment, the antenna may comprise several first access terminals 1 distinct from each other and/or several second access terminals 2 distinct from each other for the connexion of several distinct charges. The first access terminals 1 distinct from each other are distant from each other by at least one turn of the antenna. The second access terminals 2 distinct from each other are distant from each other by at least one turn of the antenna.

Figure 39:
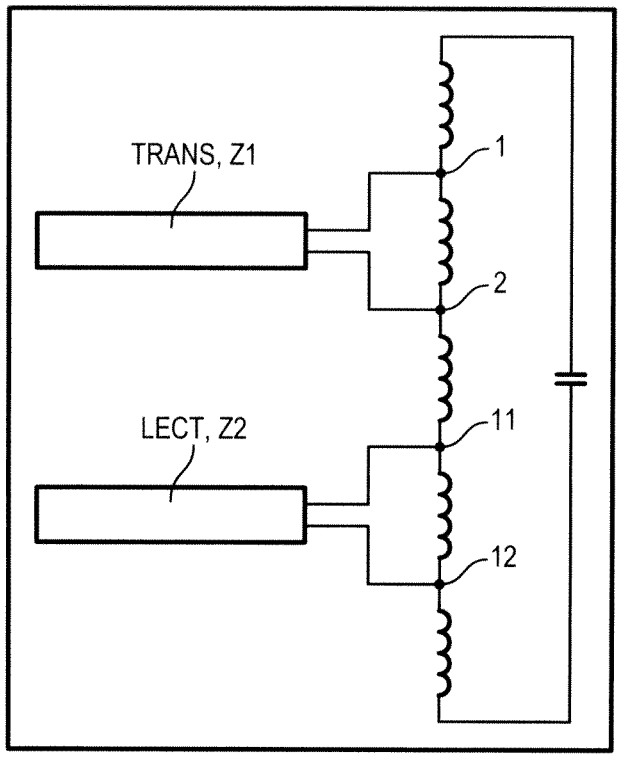

For example, on FIG. 39, a transponder TRANS as first charge Z1 is connected between the first access terminal 1 and the second access terminal 2, whereas a reader LECT as second charge Z2 is connected between another first access terminal 1 and another second access terminal 2.

Figure 40:
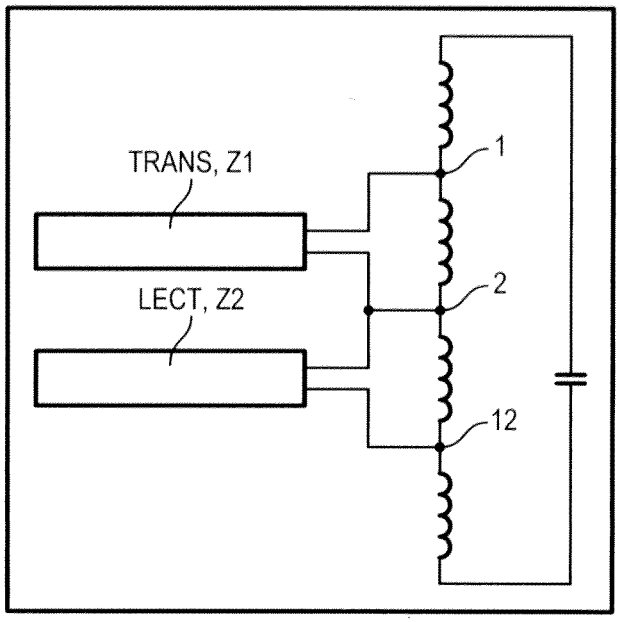

For example, on FIG. 40, a transponder TRANS as first charge Z1 is connected between the first access terminal 1 and the second access terminal 2, whereas a reader LECT as second charge Z2 is connected between another second access terminal 12 and the second access terminal 2 (successive access terminals).

Figure 41:
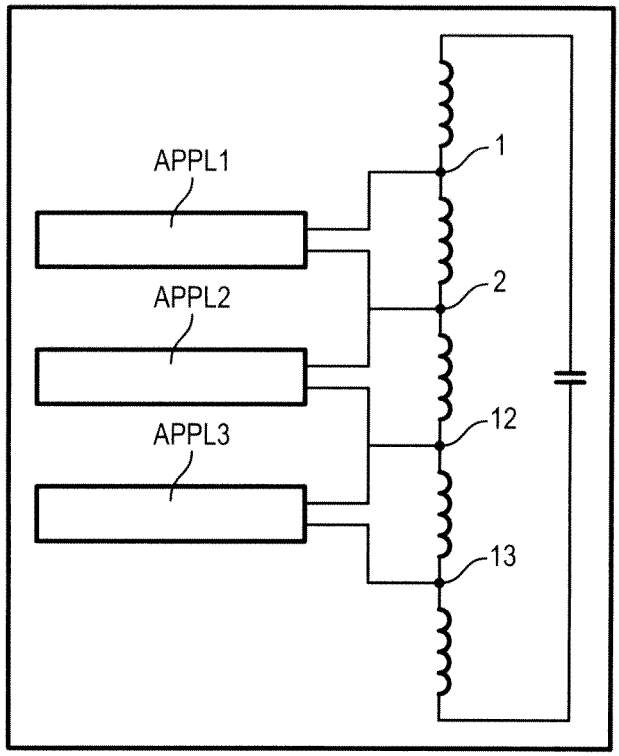

In another embodiment, several RFID applications and/or RFID reader and/or RFID transponder may be connected between the first and second identical access terminals 1, 2 or between distinct first and second access terminals 1, 2, as for example applications APPL1, APPL3 on FIG. 41 between the distinct successive first and second access terminals 1, 2, 12, 13.

Of course above, the role of the first access terminal 1 and of the second access terminal 2 may be reversed.

Figure 42:
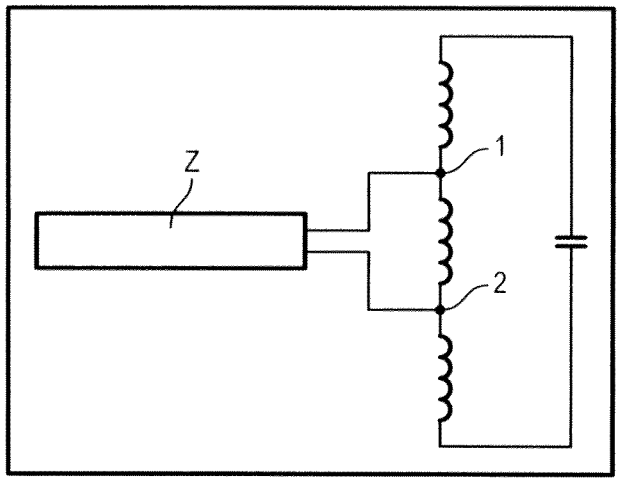

Above, the charge Z connected to access terminals 1, 2 has for example a prescribed tuning frequency, as shown on FIG. 42. This tuning frequency is fixed.

This tuning frequency is for example in a high frequency band (HF), wherein the high frequency band covers the frequencies higher than or equal to 30 kHz and lower than 80 MHz. This tuning frequency is for example 13.56 MHz.

The tuning frequency may also be in an ultra high frequency band (UHF), wherein the ultra high frequency band covers the frequencies higher than or equal to 80 MHz and lower than or equal to 5800 MHz. The tuning frequency is for example in this case 868 MHz or 915 MHz.

In an embodiment, said at least one first access terminal 1 and said at least one second access terminal 2 are connected to at least a first charge 21 having a first prescribed, tuning frequency and at least a second Z2 having a second prescribed tuning frequency different from the first prescribed tuning frequency.

In an embodiment, a first charge Z1 having the first prescribed tuning frequency in the high frequency band and a second charge Z2 having the second prescribed tuning frequency in the ultra high frequency band are connected to the access terminals 1, 2.

Figure 43:
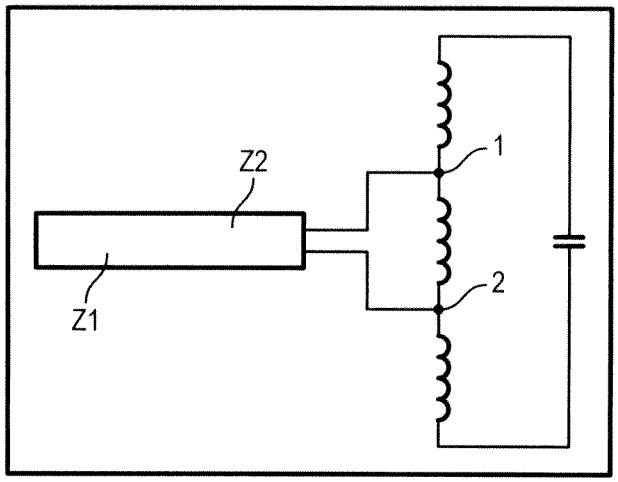

In the embodiment of FIG. 43, the first charge 21 having the first prescribed tuning frequency in the high frequency band and a second charge Z2 having the second prescribed tuning frequency in the ultra high frequency band are connected to the same first access terminal 1 and to the same second access terminal 2.

Figure 44:
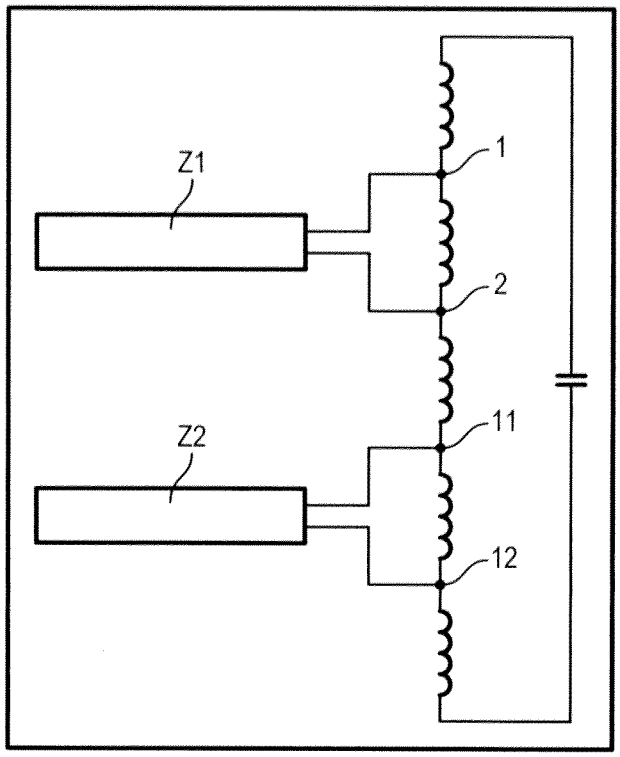

In the embodiment of FIG. 44, the first charge 21 having the first prescribed tuning frequency in the high frequency band is connected between the first access terminal 1 and the second access terminal 2, whereas the second charge Z2 having the second prescribed tuning frequency in the ultra high frequency band is connected between another first access terminal 11 and another second access terminal 12.

Figure 45:
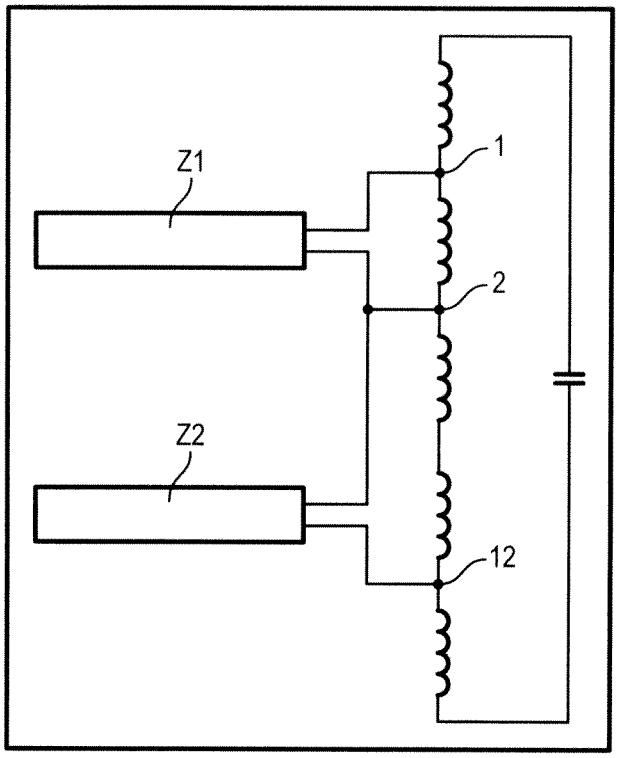
Figure 46:
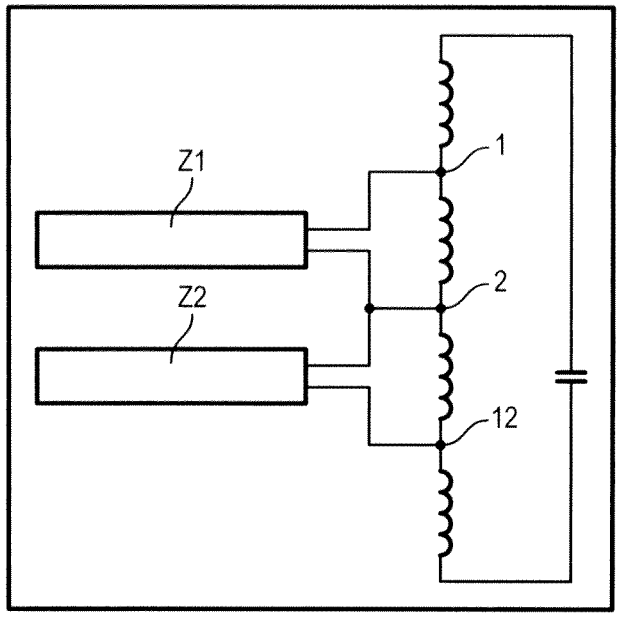

In the embodiment of FIGS. 45 and 46, the first charge Z1 having the first prescribed tuning frequency in the high frequency band is connected between the first access terminal 1 and the second access terminal 2, whereas the second charge Z2 having the second prescribed tuning frequency in the ultra high frequency band is connected between another second access terminal 12 and the second access terminal 2 (successive access terminals), the number of turns between the terminals of FIG. 45 being different from the number of turns between the terminals of FIG. 46.

The invention claimed is:

1. RFID/NFC antenna circuit comprising:

an antenna (L) formed by a number of at least three turns (S), the antenna having a first end terminal (D) and a second end terminal (E), at least two access terminals (1, 2) to connect a charge, at least one tuning capacitance (C1, ZZ) for tuning at a prescribed tuning frequency, having a first capacitance terminal (C1X) and a second capacitance terminal (C1E), an intermediate tap (A) connected to the antenna (L) and distinct from the end terminals, first connection means (CON1A) connecting the intermediate tap (A) to a first (1) of the two access terminals, second connection means (CON2E) connecting the second end terminal (E) to the second capacitance terminal (C1E), characterized in that it comprises:

third connection means (CON31, CON32) connecting the first capacitance terminal (C1X) and the second (2) of the access terminals respectively to a first point (P1) of the antenna (L) and to a second point (P2) of the antenna (L), wherein the second point (P2) is connected to the second terminal (E) of the antenna by at least one turn (S) of the antenna (L) and is connected to the first point of the antenna (L) by at least one turn (S) of the antenna (L).

2. Circuit according to claim 1, wherein the capacitance comprises a first metal surface forming the first capacitance terminal (C1X), a second metal surface forming the second capacitance terminal (C1E), at least one dielectric layer lying between the first metal surface and the second metal surface.

3. Circuit according to claim 1, wherein the capacitance comprises at least one dielectric layer having a first side and a second side distant from the first side, a first metal surface forming the first capacitance terminal (C1X) on the first side of the dielectric layer, a second metal surface forming the second capacitance terminal (C1E) on the second side of the dielectric layer, a third metal surface forming a third capacitance terminal (C1F) lying away from the first metal surface on the first side of the dielectric layer, the first capacitance terminal (C1X) defining a first capacitance value (C2) with the second capacitance terminal (C1E), the third capacitance terminal (C1F) defining a second capacitance value (C1) with the second capacitance terminal (C1E), the first capacitance terminal (C1X) defining a third coupling capacitance value (C12) with the third capacitance terminal (C1F), connection means connecting the third capacitance terminal (C1F) to one of the access terminals (1, 2).

4. Circuit according to claim 1, wherein the antenna (L) comprises at least one first turn (S1), at least one second turn and at least one third turn, which are consecutive, the first turn (S1) extending from the second end terminal (E) in a first winding direction to a reversal point (PR) connected to the second turn, the second and third turns (S2, S3) extending from said reversal point (PR) to the first end terminal (D) in a second winding direction which is the reverse of the first winding direction, the first point (P1) of the antenna (L) and the second point (P2) of the antenna (L) being located on the second and third turns (S2, S3).

5. Circuit according to claim 1, wherein the antenna (L) comprises at least one first turn (S1) and at least one second turn (S2, S3) consecutive between two third and fourth points (E; D) of the antenna, the first turn (S1) being connected to the second turn (S2, S3) by a reversal point (PR), the first turn (S1) extending from the third point (E) to the reversal point (PR) in a first winding direction, the second turn (S2, S3) extending from said reversal point (PR) to the fourth point (D) in a second direction of winding which is the reverse of the first winding direction.

6. Circuit according to claim 1, wherein the antenna (L) comprises at least one first turn (S1) and at least one second turn (S2, S3) consecutive between two third and fourth points (E; D) of the antenna, the first turn (S1) being connected to the second turn (S2, S3) by a reversal point (PR), the first turn (S1) extending from the third point (E) to the reversal point (PR) in a first direction of winding, the second turn (S2, S3) extending from said reversal point (PR) to the fourth point (D) in a second direction of winding which is the reverse of the first direction of winding, the first point (P1) is located at the intermediate tap (A) of the antenna (L) and the second point (P2) is located at the first end terminal (D) of the antenna (L).

7. Circuit according to claim 1, wherein the antenna (L) comprises at least one first turn (S1) and at least one second turn (S2, S3) consecutive between two third and fourth points (E; D) of the antenna, the first turn (S1) being connected to the second turn (S2, S3) by a reversal point (PR), the first turn (S1) extending from the third point (E) to the reversal point (PR) in a first direction of winding, the second turn (S2, S3) extending from said reversal point (PR) to the fourth point (D) in a second direction of winding which is the reverse of the first direction of winding, the first point (P1) is located at the first end terminal (D).

8. Circuit according to claim 1, wherein at least one turn (S2) of the antenna comprises in series a winding (S2') of turns of smaller surrounded surface with respect to the surface surrounded by the remainder (S2") of said turn (S2) or with respect to the surface surrounded by other turns of the antenna (3).

9. Circuit according to claim 1, wherein the tuning capacitance (C1) comprises a second capacitance (ZZ) formed by at least one third turn (SC3) comprising two first and second ends (SC31, SC32) and by at least one fourth turn (SC4) comprising two first and second ends (SC41, SC42), the third turn (SC3) being electrically separated from the fourth turn (SC4) to define at least the tuning capacitance (C1) between the first end (SC31) of the third turn (SC3) and the second end (SC42) of the fourth turn (SC4), the first end (SC31) of the third turn lying further distant from the second end (SC42) of the fourth turn (SC4) than from the first end (SC41) of the fourth turn (SC4), the second end (SC32) of the third turn (SC3) lying further distant from the first end (SC41) of the fourth turn (SC4) than from the second end (SC42) of the fourth turn (SC4), the second capacitance being defined between the first end (SC31) of the third turn (SC3) and the second end (SC42) of the fourth turn (SC4).

10. Circuit according to claim 9, wherein there is at least one turn (S1) of the antenna between the intermediate tap (A) and the second capacitance.

11. Circuit according to claim 9, wherein first coupling means are provided to ensure coupling (COUPL12) by mutual inductance between firstly the at least one turn (S2) of the antenna electrically connected in parallel with the first and second access terminals (1, 2) and secondly the other at least one turn (S1) of the antenna, second coupling means are provided to ensure coupling (COUPLZZ) by mutual inductance between said other at least one turn (S1) of the antenna and the at least one third and fourth turns (SC3, SC4) of the second capacitance (ZZ).

12. Circuit according to claim 11, wherein the first coupling means are formed by the proximity between, firstly, the at least one turn (S2) of the antenna electrically connected in parallel with the first and second access terminals (1, 2) and, secondly, the other at least one turn (S1) of the antenna, the second coupling means are formed by the proximity between said other at least one turn (S1) of the antenna and the at least one third and fourth turns (SC3, SC4) of the second capacitance (ZZ).

13. Circuit according to claim 9, wherein the third turn (SC3) and the fourth turn (SC4) are interleaved.

14. Circuit according to claim 9, wherein the third turn (SC3) comprises at least one third section, the fourth turn (SC4) comprises a fourth section, the third section lying adjacent the fourth section.

15. Circuit according to claim 14, wherein the sections extend parallel to each other.

16. Circuit according to claim 9, wherein the at least one third turn (SC3) and the at least one fourth turn (SC4) define a second sub-circuit having a second natural resonance frequency, the first and second access terminals (1, 2), together with a module (M) connected to them and with at least one turn (S2) connected to said first and second access terminals (1, 2), define a first sub-circuit having a first natural resonance frequency, the turns being arranged so that frequency difference between the first natural resonance frequency and the second natural resonance frequency is equal to or less than 10 MHz.

17. Circuit according to claim 9, wherein the at least one third turn (SC3) and the at least one fourth turn (SC4) define a second sub-circuit having a second natural resonance frequency, the first and second access terminals (1, 2) together with a module (M) connected to them and with at least one turn (S2) connected to said first and second access terminals (1, 2) define a first sub-circuit having a first natural resonance frequency, the turns being arranged so that the frequency difference between the first natural resonance frequency and the second natural resonance frequency is equal to or less than 500 KHz.

18. Circuit according to claim 9, wherein the at least one third turn (SC3) and the at least one fourth turn (SC4) define a second sub-circuit having a second natural resonance frequency, the first and second access terminals (1, 2) together with a module (M) connected to them and with at least one turn (S2) connected to said first and second access terminals (1, 2) define a first sub-circuit having a first natural resonance frequency, the turns being arranged so that the first natural resonance frequency and the second natural resonance frequency are substantially equal.

19. Circuit according to claim 1, wherein the antenna comprises a mid-point (PM) to set a potential at a reference potential, with an equal number of turns on the section extending from the first end terminal (D) to the mid-point (PM) and on the section extending from the mid-point (PM) to the second end terminal (E).

20. Circuit according to claim 1, wherein said terminals (D, E, 1, 2, C1E, C1X), said tap (A), said points (P1, P2) and the capacitance (C1, ZZ) define a plurality of at least three nodes, the nodes defining at least one first group (S1) of at least one turn between two first nodes (1, C1E) separate from each other, and at least one second group of at least one other turn (S2) between two second nodes (1, 2) separate from each other, at least one of the first nodes being different from at least one of the second nodes, first coupling means are provided to ensure coupling (COUPL12) by mutual inductance between the first group (S1) of at least one turn and the second group of at least one other turn (S2) through the fact that the first group (S1) of at least one turn is positioned in the vicinity of the second group of at least one other turn (S2).

21. Circuit according to claim 20, wherein the distance separating the turns (S1, S2, SC3, SC4) belonging to different groups is equal to or less than 20 millimeters.

22. Circuit according to claim 20, wherein the distance separating the turns (S1, S2, SC3, SC4) belonging to different groups is equal to or less than 10 millimeters.

23. Circuit according to claim 20, wherein the distance separating the turns (S1, S2, SC3, SC4) belonging to different groups is equal to or less than 1 millimeter.

24. Circuit according to claim 20, wherein the distance separating the turns (S1, S2, SC3, SC4) belonging to different groups is equal to or more than 80 micrometers.

25. Circuit according to claim 1, wherein said terminals (D, E, 1, 2, C1E, C1X), said tap (A), said points (P1, P2), and the capacitance (C1, ZZ) define a plurality of at least three nodes, the nodes defining at least one first group (S1) of at least one turn between two first nodes (1, C1E) separate from each other, and at least one second group of at least one other turn (S2) between two second nodes (1, 2) separate from each other, and at least one third group of at least one other turn (SC3, SC4) between two third nodes (E, C1X) separate from each other, at least one of the first nodes being different from at least one of the second nodes, at least one of first nodes being different from at least one of the third nodes, at least one of the third nodes being different from at least one of the second nodes, first coupling means are provided to ensure coupling (COUPL12) by mutual inductance between, firstly, the first group (S1) of at least one turn and, secondly, the second group of at least one other turn (S2) through the fact that the first group (S1) of at least one turn is positioned in the vicinity of the second group of at least one other turn (S2), second coupling means are provided to ensure coupling (COUPLZZ) by mutual inductance between firstly the first group (S1) of at least one turn and secondly the third group of at least one other turn (SC3, SC4) through the fact that the first group (S1) of at least one turn is positioned in the vicinity of the third group of at least one other turn (SC3, SC4).

26. Circuit according to claim 25, wherein the first group (S1) of at least one turn is positioned between the second group of at least one other turn (S2) and the third group of at least one other turn (SC3, SC4).

27. Circuit according to claim 1, wherein at least a reader (LECT) as charge and/or at least a transponder (TRANS) as charge is connected to the access terminals (1, 2).

28. Circuit according to claim 1, wherein it comprises several first access terminals (1) which are distinct from each other and/or several second access terminals which are distinct from each other.

29. Circuit according to claim 1, wherein said at least one first access terminal (1) and said at least one second access terminal (2) are connected to at least one first charge (Z1) having a first prescribed tuning frequency in a high frequency band and at least one second charge (Z2) having a second prescribed tuning frequency in another ultra high frequency band.

* * * * *